US007973740B2

(12) United States Patent
Masutani et al.

(10) Patent No.: US 7,973,740 B2
(45) Date of Patent: Jul. 5, 2011

(54) METHOD OF DRIVING INFORMATION DISPLAY DEVICE

(75) Inventors: Maki Masutani, Tokorozawa (JP); Norio Nihei, Kodaira (JP); Shuhei Tsuchie, Tokyo (JP)

(73) Assignee: Bridgestone Corporation, Tokyo (JP)

( * ) Notice: Subject to any disclaimer, the term of this patent is extended or adjusted under 35 U.S.C. 154(b) by 897 days.

(21) Appl. No.: 11/587,185

(22) PCT Filed: Apr. 20, 2005

(86) PCT No.: PCT/JP2005/007542

§ 371 (c)(1),
(2), (4) Date: Aug. 16, 2007

(87) PCT Pub. No.: WO2005/104078

PCT Pub. Date: Nov. 3, 2005

(65) Prior Publication Data

US 2008/0278411 A1 Nov. 13, 2008

(30) Foreign Application Priority Data

| | | |
|---|---|---|
| Apr. 21, 2004 | (JP) | 2004-125986 |
| Apr. 21, 2004 | (JP) | 2004-125988 |
| Apr. 21, 2004 | (JP) | 2004-126027 |
| Aug. 19, 2004 | (JP) | 2004-239632 |
| Aug. 19, 2004 | (JP) | 2004-239661 |

(51) Int. Cl.
*G09G 3/20* (2006.01)
*G09G 5/00* (2006.01)

(52) U.S. Cl. ..... 345/58; 345/107

(58) Field of Classification Search ..... 345/55, 345/58, 60–63, 76, 82, 84, 87, 107, 211–213, 345/690

See application file for complete search history.

(56) References Cited

U.S. PATENT DOCUMENTS 6,956,557 B2 * 10/2005 Machida et al. ..... 345/107
2003/0063076 A1 4/2003 Machida et al.

FOREIGN PATENT DOCUMENTS

CN 1402068 3/2003
EP 1 117 086 A2 7/2001

(Continued)

OTHER PUBLICATIONS

Chinese Office Action dated Dec. 21, 2007.

(Continued)

*Primary Examiner* — Kevin M Nguyen
(74) *Attorney, Agent, or Firm* — Sughrue Mion, PLLC

(57) ABSTRACT

A method of driving an information display device including displaying information of one frame by performing a scanning operation with respect to line electrodes on one substrate and column electrodes on another substrate, such that a voltage is applied to the line electrodes from one end to the other end. Then, a voltage for generating a cross-talk in the first color and a voltage for generating a cross-talk in the second color is applied to all cells one or more times respectively after the one frame is displayed. The information of the one frame is an image, and two or more lines of line electrodes are added at the end of the scanning operation, and a drive, in which a display of the first color and a display of the second color are performed one or more times respectively, is performed after the scanning operation is finished.

3 Claims, 24 Drawing Sheets

FOREIGN PATENT DOCUMENTS

| | | | |
|---|---|---|---|
| JP | 54085696 | | 7/1979 |
| JP | 2079816 | A | 3/1990 |
| JP | 05080724 | | 4/1993 |
| JP | 06222332 | | 8/1994 |
| JP | 10-143119 | A | 5/1998 |
| JP | 2002236471 | A | 8/2002 |
| JP | 20035227 | A | 1/2003 |
| JP | 2003-307755 | A | 10/2003 |
| JP | 2004-37496 | A | 2/2004 |
| WO | 03/021346 | A1 | 3/2003 |
| WO | 03100757 | A1 | 12/2003 |

OTHER PUBLICATIONS

Supplementary European Search Report dated Jul. 2, 2008.

Japanese Office Action dated Aug. 17, 2010.

New Toner Display Device (I), Image Display Using Conductive Toner and Charge Transport Layer, Gugrae-Jo, Katsuhiko Sugawara, Katsuyoshi Hoshino and Takashi Kitamura. Graduate School of Science and Technology, Chiba University. Information and Image Sciences Department, Faculty of Engineering, Chiba University. Japan Hardcopy '99. pp. 249-252.

Japanese Office Action dated Nov. 16, 2010.

Reiji Hattori, Shuhei Yamada, 20.3 Novel Type of Bistable Reflective Display using Quick Response Liquid Power, 2003 SID International Symposium Disgest of Technical Papers, vol. XXXIV, Book II, USA, Society for Information Display, May 2003, 846-849.

* cited by examiner (a)

(b)

(a)

(b)

(a)

row 1 selected state (timing 1)

(b)

row 2 selected state (timing 2)

METHOD OF DRIVING INFORMATION DISPLAY DEVICE

TECHNICAL FIELD

The present invention relates to a method of driving an information display device, in which two groups of display media having at least first color and second color are sealed between opposed two substrates, at least one substrate being transparent, and, in which the display media, to which an electrostatic field is applied from the electrodes, are made to move so as to display information such as an image (first aspect and second aspect of the invention).

Moreover, the present invention relates to a method of driving an information display device, in which display media are sealed between opposed two substrates, at least one substrate being transparent, and, in which the display media, to which an electrostatic field is applied from electrodes, are made to move so as to display information such as an image (third aspect of the invention).

BACKGROUND ART

As an information display device substitutable for liquid crystal display (LCD), information display devices with the use of technology such as an electrophoresis method, an electro-chromic method, a thermal method, dichroic-particles-rotary method are proposed.

As for these information display devices, it is conceivable as inexpensive visual display device of the next generation from a merit having wide field of vision close to normal printed matter, having smaller consumption with LCD, or having a memory function, and spreading out to a display for portable device and an electronic paper is expected. Recently, electrophoresis method is proposed that microencapsulate dispersion liquid made up with dispersion particles and coloration solution and dispose the liquid between faced substrates, and also it is expected.

However, in the electrophoresis method, there is a problem that a response rate is slow by the reason of viscosity resistance because the particles migrate among the electrophoresis solution. Further, there is a problem of lacking imaging repetition stability, because particles with high specific gravity of titanium oxide is scattered within solution of low specific gravity, it is easy to subside, difficult to maintain a stability of dispersion state. Even in the case of microencapsulating, cell size is diminished to a microcapsule level in order to make it hard to appear, however, an essential problem was not overcome at all.

Besides the electrophoresis method using behavior in the solution, recently, a method wherein electro-conductive particles and a charge transport layer are installed in a part of the substrate without using solution is proposed. [The Imaging Society of Japan "Japan Hardcopy '99" (Jul. 21-23, 1999) Transaction Pages 249-252] However, the structure becomes complicated because the charge transport layer and further a charge generation layer are to be arranged. In addition, it is difficult to constantly dissipate charges from the electro-conductive particles, and thus there is a drawback on the lack of stability.

As one method for overcoming the various problems mentioned above, an information display device comprising an information display panel is known, in which the display media (particles or liquid powders) are sealed between a front substrate having a front electrode and a rear substrate having a rear electrode, and, in which the display media, to which an electrostatic field is applied, are made to move by means of Coulomb's force and so on so as to display information such as an image.

Task of the First Aspect of the Invention

In the information display device using the display media mentioned above, when information of one frame such as an image is displayed by performing a scanning operation with respect to line electrodes consisting of a plurality of electrodes extending in a line direction on one substrate and column electrodes consisting of a plurality electrodes extending in a column direction on the other substrate in such a manner that a voltage is applied to the line electrodes from one end to the other end, there is a drawback such that a cross-talk occurs in the case of driving so as to perform a matrix display or in the case of driving segments in a dynamic manner.

The cross-talk is basically a phenomenon such that one line is mixed with the other line on the phone. However, in this case, the cross-talk is a phenomenon such that, even if the column electrode is not selected, an image other than actual one is displayed due to the other lines. When the image is displayed by a passive matrix driving in the information display device using the display media mentioned above, a voltage is applied to a non-selected line of the column electrodes so as to maintain the image. Since the maintaining voltage is applied only to the number of the lines of the column electrodes, a contrast becomes worse, and a shading of an image display is generated according to a display pattern, so that the image is lacking in color uniformity.

Task of the Second Aspect of the Invention

In the information display device using the display media mentioned above, when information of one frame such as an image is displayed by performing a scanning operation with respect to line electrodes consisting of a plurality of electrodes extending in a line direction on one substrate and column electrodes consisting of a plurality electrodes extending in a column direction on the other substrate in such a manner that a voltage is applied to the line electrodes from one end to the other end, there is a drawback such that a cross-talk occurs in the case of driving so as to perform a matrix display or in the case of driving segments in a dynamic manner.

The cross-talk is basically a phenomenon such that one line is mixed with the other line on the phone. However, in this case, the cross-talk is a phenomenon such that, even if the column electrode is not selected, an image other than actual one is displayed due to the other lines. When the image is displayed by a passive matrix driving in the information display device using the display media mentioned above, a voltage is applied to a non-selected line of the column electrodes so as to maintain the image. Since the maintaining voltage is applied only to the number of the lines of the column electrodes, a shading of an image display is generated, and the image is lacking in color uniformity.

FIG. 25 is a schematic view showing a shading non-uniformity due to the cross-talk in the known image display device. In the embodiment shown in FIG. 25, for the sake of simplicity, 8×6 image consisting of line electrodes 51-1 to 51-6 at a lower side and column electrodes 52-1 to 52-8 at an upper side is shown. In addition, the display media having a white color and a black color and having different characteristics with each other are filled between the line electrodes and the column electrodes, and a white & black color display is performed in response to a voltage applied between the line electrodes 51-1 to 51-6 and the column electrodes 52-1 to 52-8. As to a driving method, use is made of a line deleting method in which a deleting operation and a writing operation are repeated on every line, and a scanning operation is performed to the line electrodes 51-1 to 51-6 in this order so as to display an image. When the scanning operation is performed, a deleting operation for the selected line of the line electrodes 51-1 to 51-6 is performed by applying a voltage 100 and its writing operation is performed by applying a voltage 0. In addition, a deleting operation for the non-selected lie is performed by applying a voltage 50. at the same time, a deleting operation for the column electrodes 52-1 to 52-8 is performed by applying a voltage 0, and its writing operation for a writing column is performed by applying a voltage 100, while applying a voltage 0 to the column other than the writing column.

In the embodiment shown in FIG. 25, the scanning operation starts from the first line electrode 51-1 and is finished at the last line electrode 51-6. In FIG. 25, among the first line electrode 51-1 and the second line electrode 51-2, a portion at which a white color should be displayed is displayed as a white gray color, and a portion at which a black color should be displayed is displayed as a black gray color, so that a shading of an image display is generated and the image is lacking in color uniformity.

Task of the Third Aspect of the Invention

In the information display device using the display media mentioned above, when the driving is performed by a passive matrix driving method and a dynamic driving method (segment panel), there is a drawback such that a contrast is decreased due to a cross-talk voltage applied to non-rewriting pixels.

The cross-talk is basically a phenomenon such that one line is mixed with the other line on the phone. However, in this case, the cross-talk is a phenomenon such that, even if the column electrode is not selected, an image other than actual one is displayed due to the other lines. When the image is displayed by a passive matrix driving in the information display device using the display media mentioned above, a voltage is applied to a non-selected line of the column electrodes so as to maintain the image. Since the maintaining voltage is applied only to the number of the lines of the column electrodes, a shading of an image display is generated, and the image is lacking in color uniformity.

DISCLOSURE OF INVENTION

First Aspect of the Invention

An object of a first aspect of the invention is to eliminate the drawbacks mentioned above and to provide a method of driving an information display device, which can remove a color non-uniformity of the image due to the cross-talk.

According to a first aspect of the invention, a method of driving an information display device, in which two groups of display media having at least first color and second color are sealed between opposed two substrates, at least one substrate being transparent, and, in which the display media, to which an electrostatic field is applied from electrodes arranged respectively to the substrates, are made to move so as to display information such as an image, is characterized in that, when information of one frame such as an image is displayed by performing a scanning operation with respect to line electrodes consisting of a plurality of electrodes extending in a line direction on one substrate and column electrodes consisting of a plurality electrodes extending in a column direction on the other substrate in such a manner that a voltage is applied to the line electrodes from one end to the other end, a voltage for generating a cross-talk in the first color and a voltage for generating a cross-talk in the second color are applied to all the cells of a display portion once or more times respectively after one frame is displayed.

As a preferred embodiment of the method of driving the information display device according to the first aspect of the invention, there are cases: such that two or more lines are added at the end of the scanning operation, and a drive, in which a display of the first color and a display of the second color are performed one or more times respectively, is performed after one scanning operation is finished; and such that a deleting operation of the image prior to the image display is performed by a line deleting method in which the image is written one by one for the lines after the lines are deleted respectively, or, by a full deleting method in which the image is written one by one for the lines after all the lines are deleted at the same time.

In the method of driving the information display device according to the first aspect of the invention: since a voltage for generating a cross-talk in the first color and a voltage for generating a cross-talk in the second color are applied to all the cells of a display portion once or more times respectively after one frame is displayed; or preferably since two or more lines are added at the end of the scanning operation, and a drive, in which a display of the first color and a display of the second color are performed one or more times respectively, is performed after one scanning operation is finished; when a white color & black color display is performed for example, a white color can be displayed as a slightly black pale gray, and a black color can be displayed as a slightly white dark gray, so that it is possible to prevent a color non-uniformity of the image due to the cross-talk.

Second Aspect of the Invention

An object of a second aspect of the invention is to eliminate the drawbacks mentioned above and to provide a method of driving an information display device, which can remove a color non-uniformity of the image and a decrease of contrast due to the cross-talk.

According to the second aspect of the invention, a method of driving an information display device, in which two groups of display media having at least first color and second color are sealed between opposed two substrates, at least one substrate being transparent, and, in which the display media, to which an electrostatic field is applied from the electrodes, are made to move so as to display information such as an image, is characterized in that, as a driving voltage applied to the electrodes for generating an electrostatic field, use is made of a pulse voltage which is composed of a plurality of voltages consisting of a driving voltage generating an ON state and a voltage of not larger than a threshold value, at which the display media start to move, generating an OFF state. Here, a driving voltage V is larger than a threshold voltage $V_1$ ($V>V_1>V_0$: $V_0$ means a voltage lower than the threshold value).

As a preferred embodiment of the method of driving the information display device according to the second aspect of the invention, there are cases: such that a duty ratio (=pulse width/(pulse width+period of the OFF state)) of the pulse voltage is not larger than 0.9; and such that a period of the OFF state is not less than 0.1 msec.

In the method of driving the information display device according to the second aspect of the invention, since, as a driving voltage applied to the electrodes for generating an electrostatic field, use is made of a pulse voltage which is composed of a plurality of voltages consisting of a driving voltage generating an ON state and a voltage of not larger than a threshold value, at which the display media start to move, generating an OFF state, it is possible to remove a color non-uniformity of the image and a decrease of contrast due to the cross-talk.

Third Aspect of the Invention

An object of a third aspect of the invention is to eliminate the drawbacks mentioned above and to provide a method of driving an information display device, which can remove a decrease of contrast due to the cross-talk voltage.

According to the third aspect of the invention, a method of driving an information display device, in which display media are sealed between opposed two substrates, at least one substrate being transparent, and, in which the display media, to which an electrostatic field is applied from electrodes, are made to move so as to display information such as an image, is characterized in that, when a pixel rewriting operation is performed once, a plurality of pulses are applied, and, during the one pixel rewriting operation, a driving waveform is adjusted in such a manner that a polarity of a cross-talk voltage applied to a non-rewriting pixel is not changed.

As a preferred embodiment of the method of driving the information display device according to the third aspect of the invention, there are cases: such that, during the period for which a plurality of pulses are applied when the pixel rewriting operation is performed once, a peak-to-peak distance of the pulse voltages applied to the rewriting pixel is made wide; and such that a row (scan) driving voltage and a column driving voltage are composed of a pulse train with same cycle and same duty, and, when the pulse train at a row side is selected, a phase of the pulse train of the row driving voltage and the column driving voltage is inverted respectively.

In the method of driving the information display device according to the third aspect of the invention, since, when a pixel rewriting operation is performed once, a plurality of pulses are applied, and, during the one pixel rewriting operation, a driving waveform is adjusted in such a manner that a polarity of a cross-talk voltage applied to a non-rewriting pixel is not changed, it is possible to remove a decrease of contrast due to the cross-talk voltage.

BEST MODE FOR CARRYING OUT THE INVENTION

Figure 1:
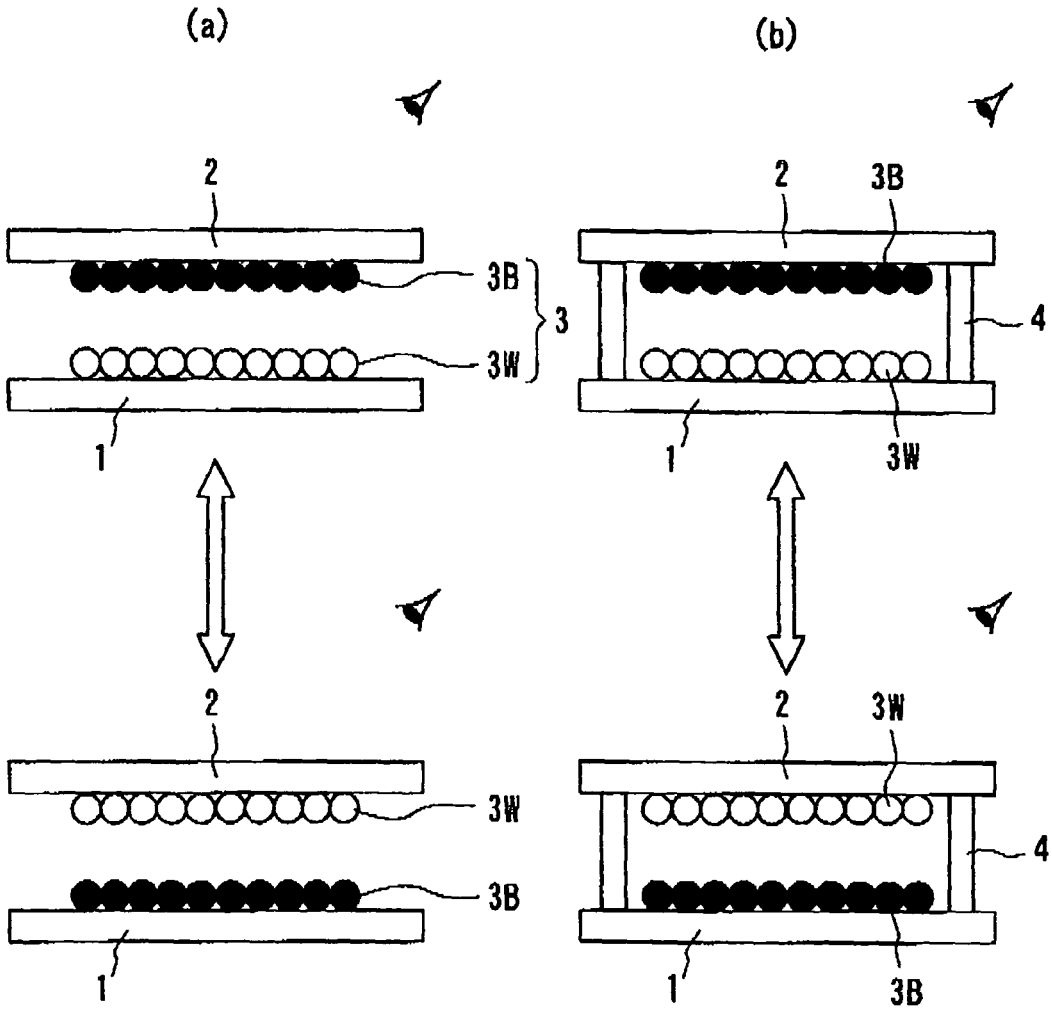
FIGS. 1*a* and 1*b* are schematic views respectively showing one embodiment of an information display panel installed in the image display device according to the invention.
Figure 2:
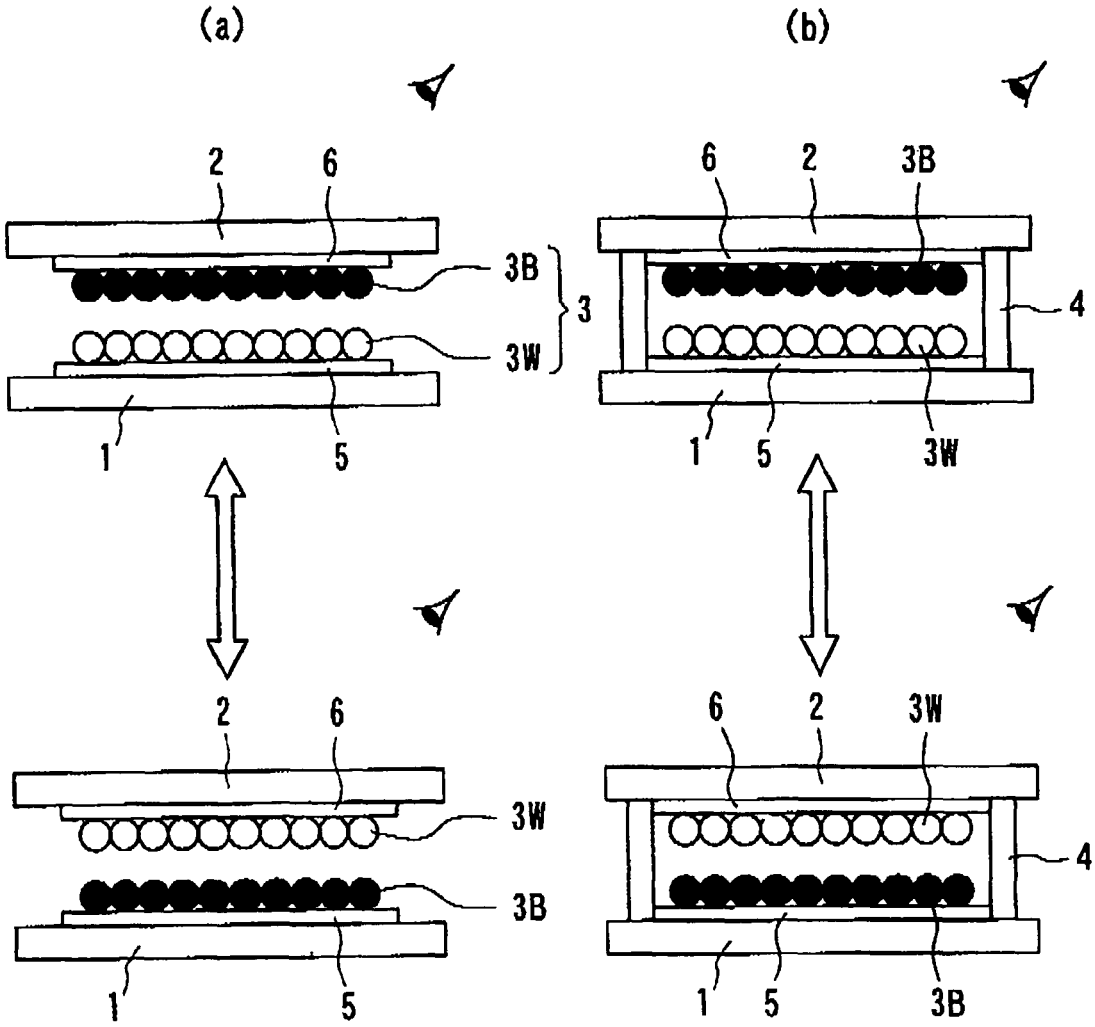
FIGS. 2*a* and 2*b* are schematic views respectively illustrating another embodiment of the information display panel installed in the image display device according to the invention.
Figure 3:
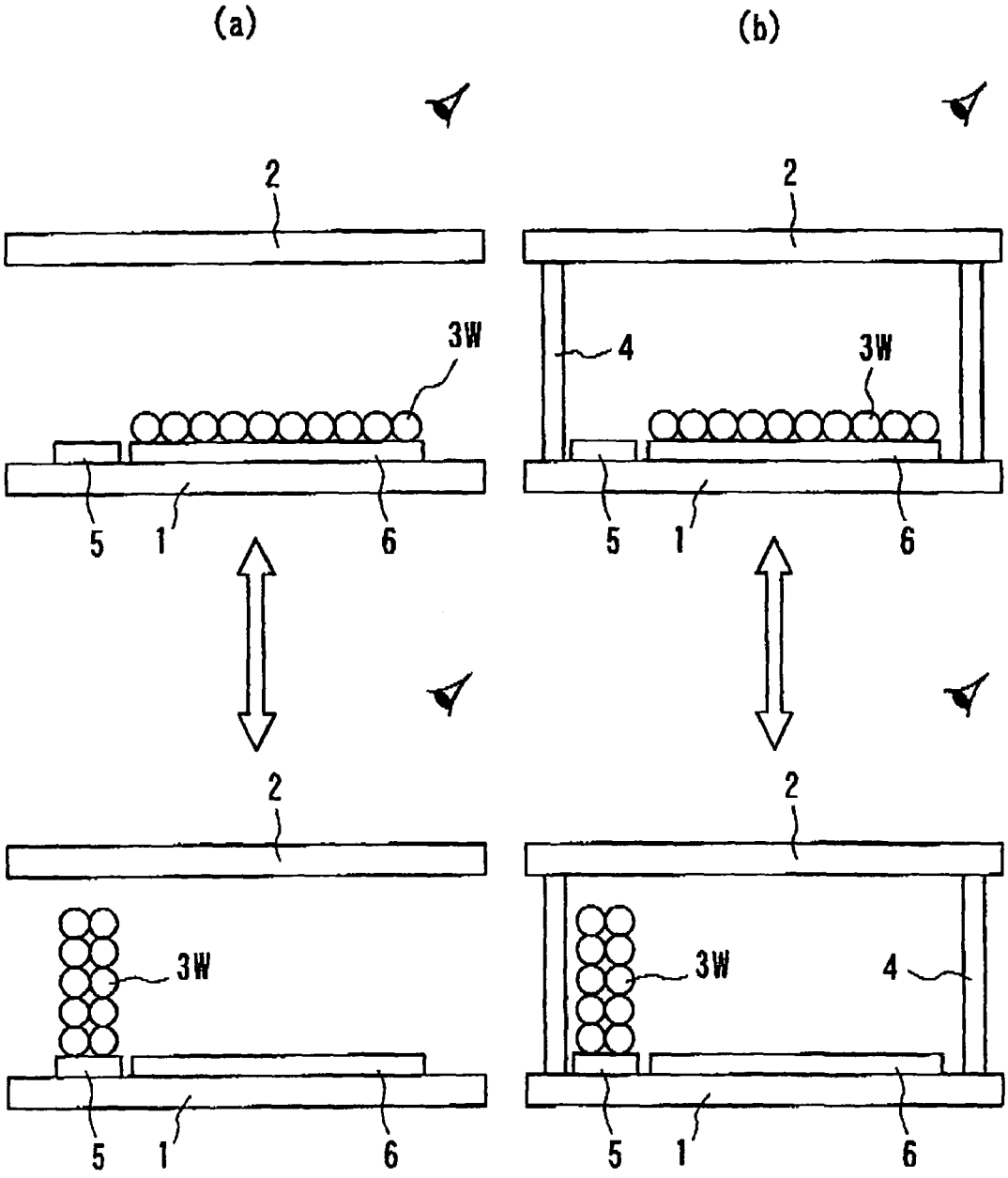
FIGS. 3*a* and 3*b* are schematic views respectively depicting still another embodiment of the information display panel installed in the image display device according to the invention.

At first, a basic construction of an information display panel used for an information display device utilizing the particles according to the invention will be explained. In the information display panel used in the present invention, an electrostatic field is applied to the particles sealed between opposed two substrates. Charged particles are attracted along a direction of electrostatic field to be applied by means of Coulomb's force in such a manner that the particles charged at a low potential are attracted toward a high potential side and the particles charged at a high potential are attracted toward a low potential side, and thus the particles can be moved reciprocally by varying a direction of electrostatic field due to a switching operation of potential. Accordingly, an image can be displayed. Therefore, it is necessary to design the information display panel in such a manner that the display media can move evenly and maintain stability during a reciprocal operation or during a reserving state. Here, as to forces applied to the particles, there are an attraction force between the particles due to Coulomb' force, an imaging force with respect to the electrode panel, an intermolecular force, a liquid bonding force and a gravity.

Examples of the information display panel that is a object of the invention will be explained with reference to FIGS. 1*a* and 1*b*-FIGS. 3*a* and 3*b*.

In the examples shown in FIGS. 1*a* and 1*b*, at least two or more groups of display media 3 having different optical reflectance and different charge characteristics and consisting of at least one or more groups of particles (here, a white color display media 3W made of the particles and a black color display media 3B made of the particles are shown) are moved in a perpendicular direction with respect to substrates 1 and 2, in accordance with an electric field generated by applying a voltage between electrodes (not shown) arranged outside of the substrates 1 and 2, so as to display a black color by viewing the black color display media 3B to an observer or so as to display a white color by viewing the white color display media 3W to the observer. In the example shown in FIG. 1*b*, a cell is formed by arranging for example grid-like partition walls 4 between the substrates 1 and 2, in addition to the example shown in FIG. 1*a*. Moreover, in FIG. 1*b*, the partition walls arranged at the near side are omitted.

In the examples shown in FIGS. 2*a* and 2*b*, at least two or more groups of display media 3 having different colors and different charge characteristics and consisting of at least one or more groups of particles (here, a white color display media 3W made of the particles and a black color display media 3B made of the particles are shown) are moved in a perpendicular direction with respect to substrates 1 and 2, in accordance with an electric field generated by applying a voltage between an electrode 5 arranged to the substrate 1 and an electrode 6 arranged to the substrate 2, so as to display a black color by viewing the black color display media 3B to an observer or so as to display a white color by viewing the white color display media 3W to the observer. In the example shown in FIG. 2*b*, a cell is formed by arranging for example grid-like partition walls 4 between the substrates 1 and 2, in addition to the example shown in FIG. 2*a*. Moreover, in FIG. 2*b*, the partition walls arranged at the near side are omitted.

In the examples shown in FIGS. 3*a* and 3*b*, at least one group of display media 3 having one color and one charge characteristic and consisting of at least one or more groups of particles (here, a white color display media 3W made of the particles) are moved in a parallel direction with respect to substrates 1 and 2, in accordance with an electric field generated by applying a voltage between the electrode 5 arranged to the substrate 1 and the electrode 6 arranged to the substrate 1, so as to display a white color by viewing the white color display media 3W to an observer or so as to display a color of the electrode 6 or the substrate 1 by viewing a color of the electrode 6 or the substrate 1 to the observer. In the example shown in FIG. 3*b*, a cell is formed by arranging for example grid-like partition walls 4 between the substrates 1 and 2, in addition to the example shown in FIG. 3*a*. Moreover, in FIG. 3*b*, the partition walls arranged at the near side are omitted.

The above explanations can be applied to a case such that the white color display media 3W are substituted by white color display media made of liquid powders or a case such that the black color display media 3B are substituted by black color display media made of liquid powders.

Explanation of First Aspect of the Invention

A feature of the method of driving the information display device according to the first aspect of the invention is that, when information of one frame such as an image is displayed by performing a scanning operation with respect to line electrodes consisting of a plurality of electrodes extending in a line direction on one substrate and column electrodes consisting of a plurality electrodes extending in a column direction on the other substrate in such a manner that a voltage is applied to the line electrodes from one end to the other end, a voltage for generating a cross-talk in the first color=cross-talk voltage 1 and a voltage for generating a cross-talk in the second color=cross-talk voltage 2 are applied to all the cells of a display portion once or more times respectively after one frame is displayed. Here, as to the cross-talk voltages 1 and 2, when a voltage 100 and a voltage −100 are applied so as to display a white color as a first color and a black color as a second color, a voltage 50 is applied as the cross-talk voltage 1 and a voltage −50 is applied as the cross-talk voltage 2. Specifically, there is a case such that two or more lines are added at the end of the scanning operation, and a drive, in which a display of the first color and a display of the second color are performed one or more times respectively, is performed after one scanning operation is finished.

Figure 25:
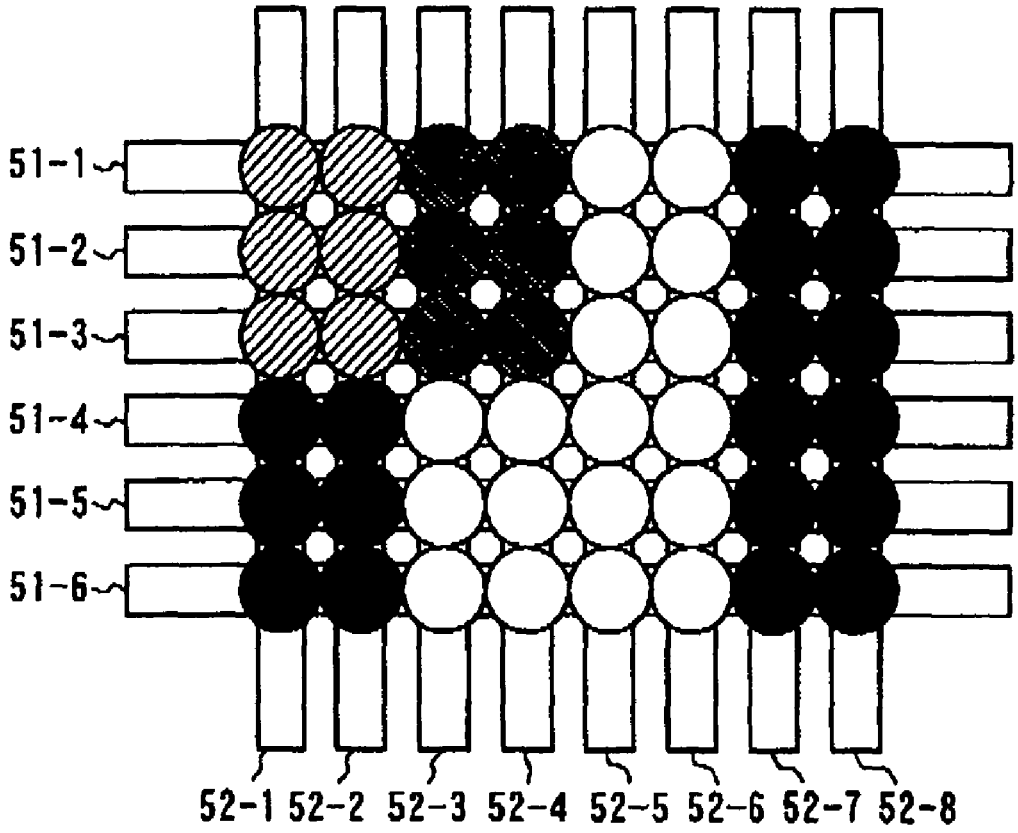
FIG. 25 is a schematic view explaining a color non-uniformity of the image due to the cross-talk in the known information display device.

FIGS. 4*a*, 4*b* and FIGS. 5*a*, 5*b* are schematic views respectively explaining one embodiment in which a driving method according to the invention is incorporated into the known one shown in FIG. 25. In the embodiments shown in FIGS. 4*a*, 4*b* and FIGS. 5*a*, 5*b*, line electrodes 11-7, 11-8 are previously added to line electrodes 11-1 to 11-6 and column electrodes 12-1 to 12-8 as is the same as the known one shown in FIG. 25.

Figure 4:
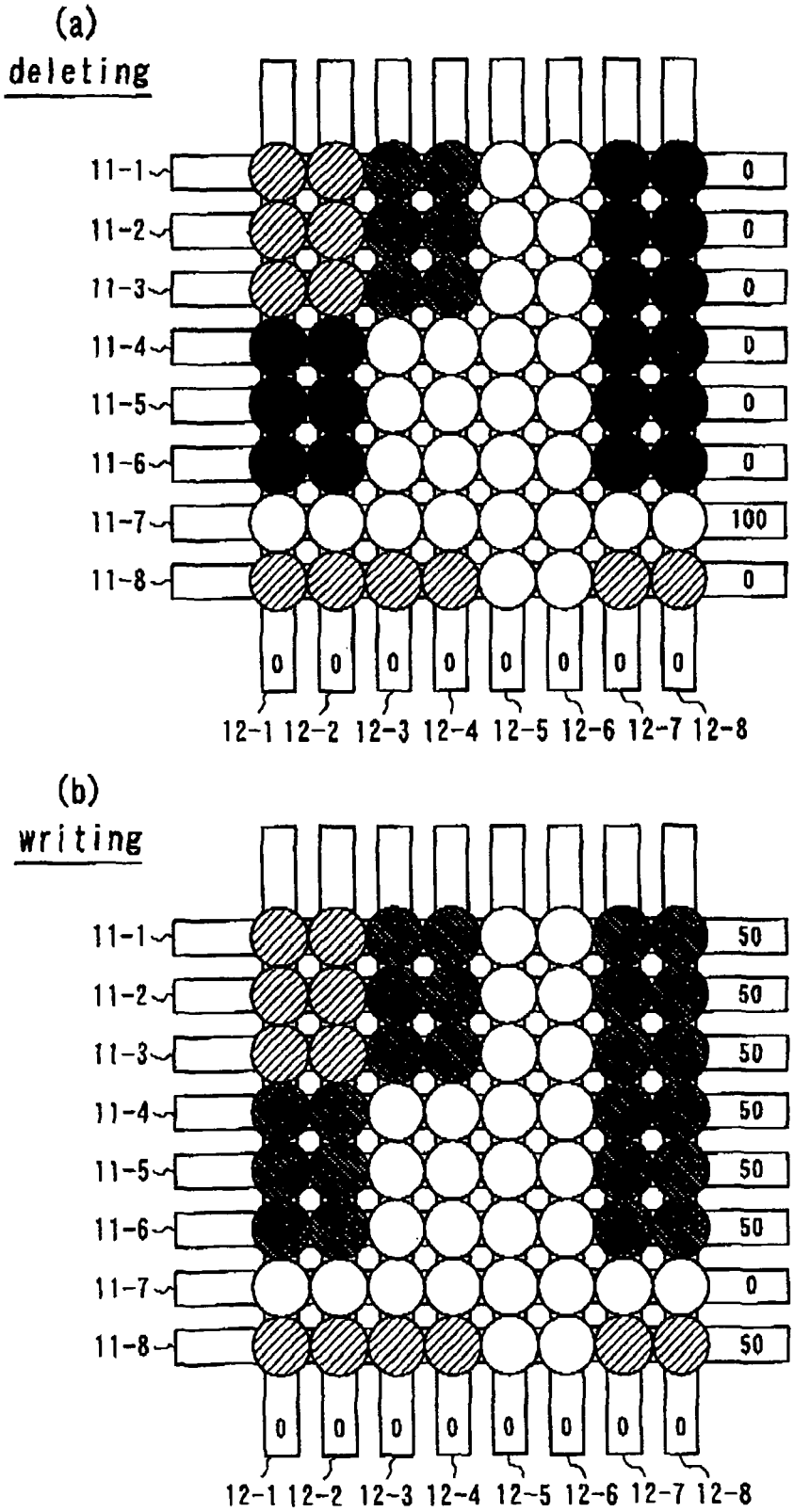
FIGS. 4*a* and 4*b* are schematic views respectively explaining one embodiment in which a driving method of the information display device according to the first aspect of the invention is incorporated into the known one shown in FIG. 25.
Figure 5:
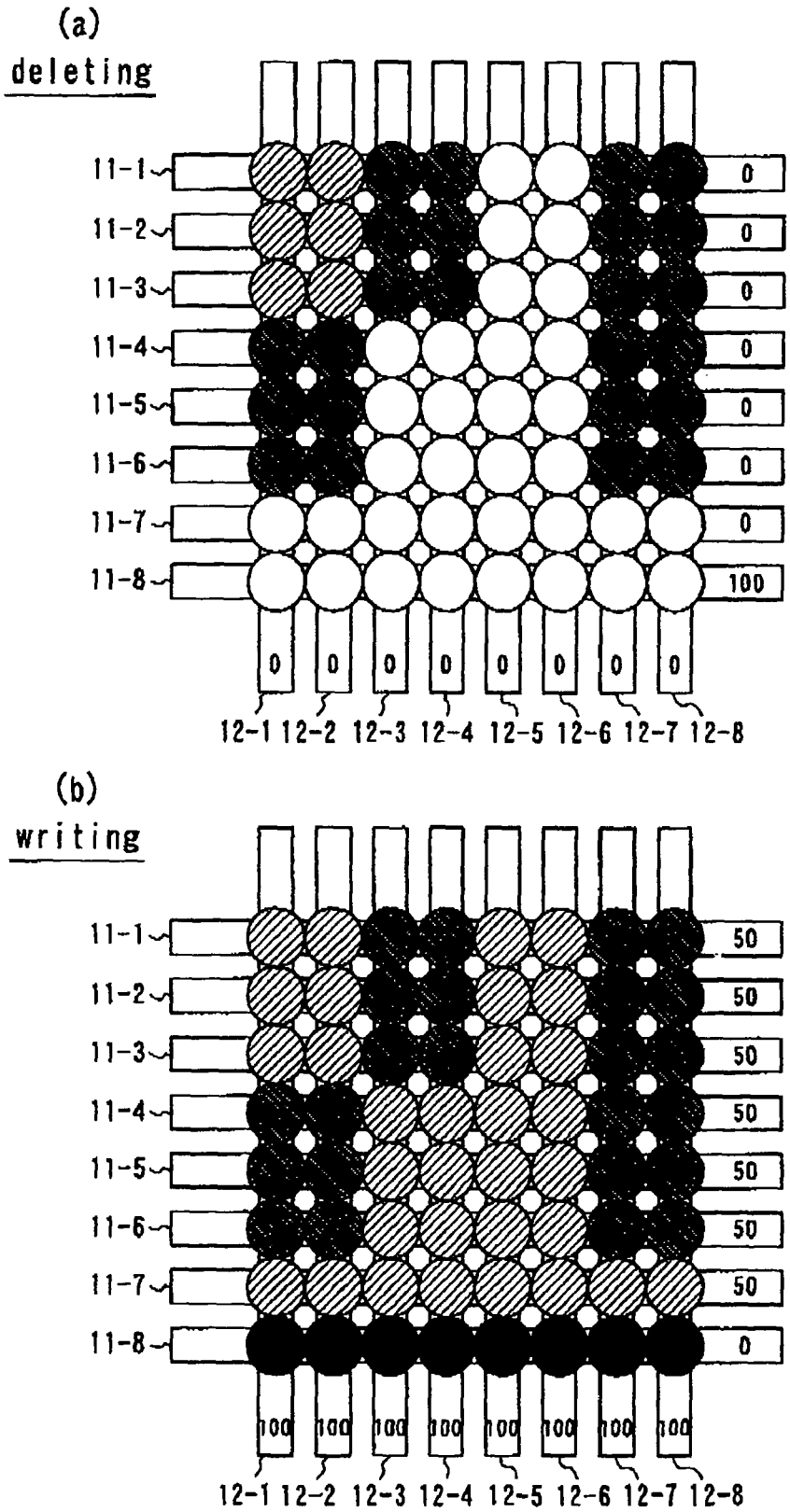
FIGS. 5*a* and 5*b* are schematic views respectively explaining another embodiment in which a driving method of the information display device according to the first aspect of the invention is incorporated into the known one shown in FIG. 25.

In the embodiments shown in FIGS. 4*a* and 4*b*, after a scanning operation for an image display portion, i.e., after one frame of information such as an image consisting of 8×6 pixels is displayed by performing a scanning operation till the line electrode 11-6, with respect to a first line electrode 11-7 in the last two lines, a deleting operation is performed as shown in FIG. 4*a* and then a writing operation of a white color is performed as shown in FIG. 4*b*. Next, with respect to a second line electrode 11-8 in the last two lines, a deleting operation is performed as shown in FIG. 5*a* and then a writing operation of a black color is performed as shown in FIG. 5*b*. As a result, as shown in FIG. 5*b*, the white color is integrated as a pale gray and the black color is integrated as a dark gray. In this case, 100% white color and 100% black color cannot be obtained, but all the portions to be displayed in a white color are displayed in a pale gray and all the portions to be displayed in a black color are displayed in a dark gray. Therefore, it is possible to completely eliminate a shading non-uniformity due to the cross-talk.

In the embodiments shown in FIGS. 4*a*, 4*b* and FIGS. 5*a*, 5*b*, the explanation is made to a line deleting method in which the writing operation is performed after the deleting operation line by line. However, if use is made of a full deleting method in which the writing operation is performed line by line after the deleting operation for all the lines is performed at the same time, it is possible to eliminate a shading non-uniformity as is the same as the line deleting method. Moreover, the deleting operation is performed by a white color deleting method. However, if use is made of a black color deleting method, it is possible to eliminate a shading non-uniformity, as is the same as the white color deleting method. Further, in the embodiments shown in FIGS. 4*a*, 4*b* and FIGS. 5*a*, 5*b*, the line electrodes 11-7 and 11-8 are actually added so as to display a white & black color by means of the display media. However, if the electrodes are not arranged, and, two or more driving lines are added, to which a voltage for performing a white color display and a voltage for performing a black color display are applied, it is possible to eliminate a shading non-uniformity in the same manner.

As mentioned above, in the method of driving the information display device according to the first aspect of the invention, on the assumption of generating the cross-talk, the first color (for example white color) or the second color (for example black color) is mixed with the pixel with a gray color due to the generated cross-talk so as to make the first color to a pale gray or the second color to a dark gray. In this manner, an elimination of shading is the most important feature.

Figure 6:
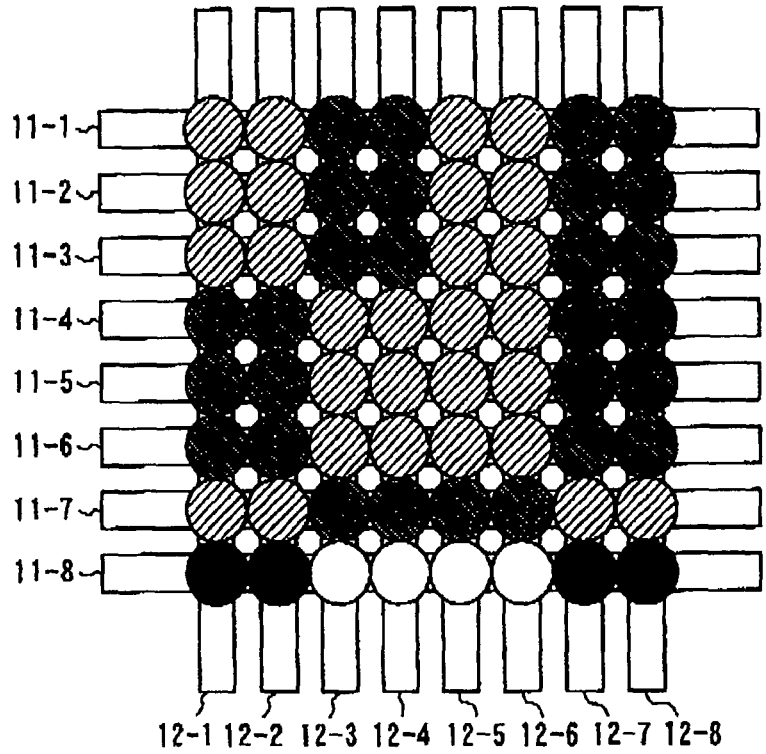
FIGS. 6*a* and 6*b* are schematic views respectively explaining another embodiment of the method of driving the information display device according to the first aspect of the invention.
Figure 6:
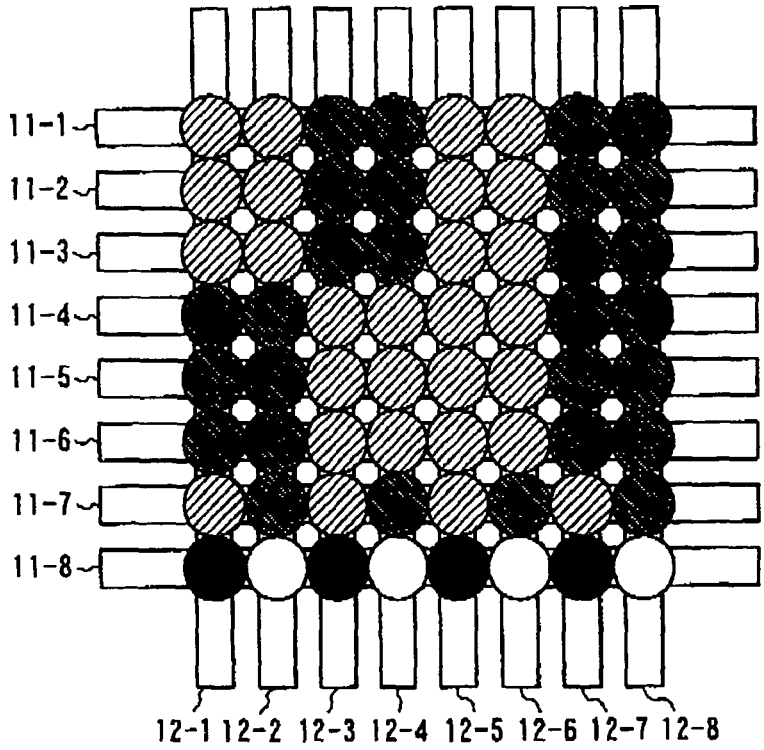

FIGS. 6*a* and 6*b* are schematic views respectively explaining another embodiment of the method of driving the information display device according to the first aspect of the invention. As shown in FIGS. 6*a* and 6*b*, if a checker pattern is displayed on the line electrode 11-7 and 11-8, a shading non-uniformity can be eliminated, as is the same as the embodiments shown in FIGS. 4*a*, 4*b* and FIGS. 5*a*, 5*b*. The checker pattern display can be performed in the following manner. That is, when the first color display and the second color display are performed with respect to respective columns in the last two lines, a zigzag display, in which an order of the first color display and the second color display is different on respective columns, is performed. Moreover, when a voltage for displaying the first color and a voltage for displaying the second color are applied between newly arranged line electrodes and respective column electrodes, a zig-zag display, in which a voltage is applied in such a manner that an order of the first color display and the second color display is different on respective columns, is performed.

Figure 7:
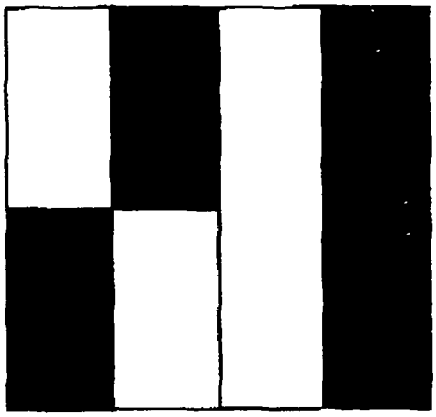
FIG. 7 is a schematic view explaining effects of the method of driving the information display device according to the first aspect of the invention.
Figure 8:
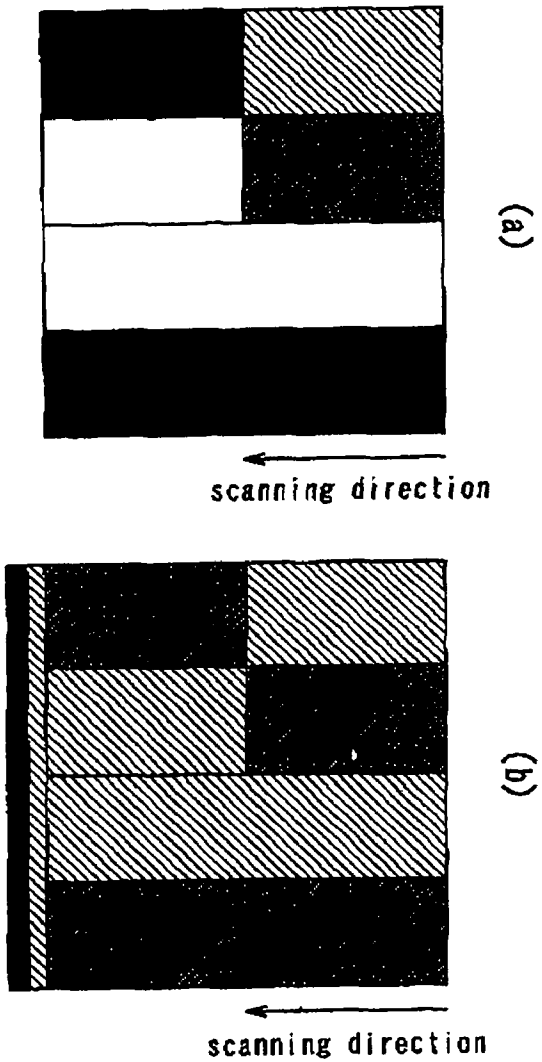
FIGS. 8*a* and 8*b* are schematic views respectively explaining effects of the method of driving the information display device according to the first aspect of the invention.
Figure 9:
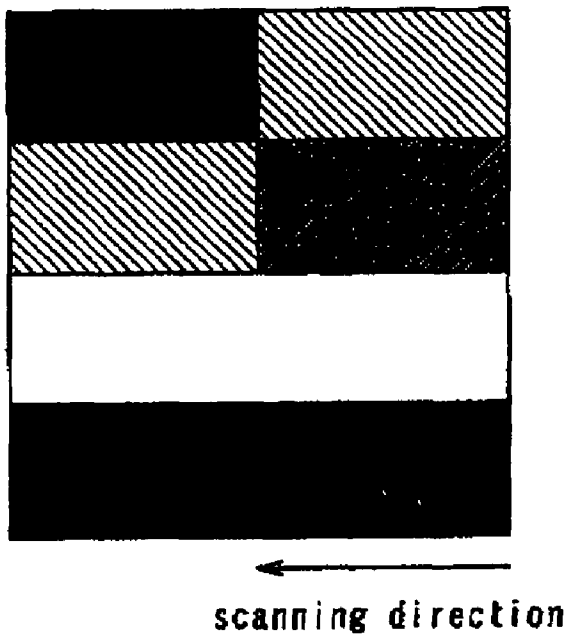
FIGS. 9*a* and 9*b* are schematic views respectively explaining effects of the method of driving the information display device according to the first aspect of the invention.
Figure 9:
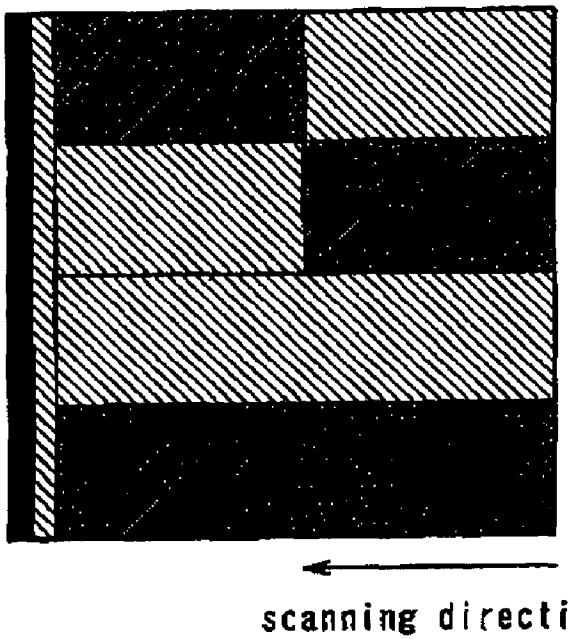

Then, an example, in which the method of driving the information display device according to the first aspect of the invention is actually applied, will be explained. FIG. 7, FIGS. 8*a*, 8*b* and FIGS. 9*a*, 9*b* are schematic views respectively explaining the information display device according to the first aspect of the invention. At first, it is assumed that a pattern image shown in FIG. 7 is displayed. Then, an example, in which the pattern image is displayed by the line deleting method according to the known driving method, is shown in FIG. 8*a*, and an example, in which the pattern image is displayed by the line deleting method according to the driving method of the present invention such that the white color and the black color are written in the last two lines, is shown in FIG. 8*b*. Moreover, an example, in which the pattern image is displayed by the full deleting method according to the known driving method, is shown in FIG. 9*a*, and an example, in which the pattern image is displayed by the full deleting method according to the driving method of the present invention such that the white color and the black color are written in the last two lines, is shown in FIG. 9*b*. As compared with FIGS. 8*a* and 8*b*, or, FIGS. 9*a* and 9*b*, both in the line deleting method and the full deleting method, an image shading due to the cross-talk is remarkably detected in the known examples, but no image shading due to the cross-talk is detected in the examples according to the invention.

In the examples mentioned above, the voltage 100 applied when the pixel is deleted and written is not explained, but image shading is largely different by a voltage V in response to the structure of the image display device. Generally, if the voltage V is low, a black color display is not performed. On the other hand, if the voltage V is high, there is no difference between a gray portion due to the cross-talk and a black portion. Therefore, according to the structure of the image display device, it is necessary to select most suitable voltage. As one example, use is made of a voltage in a range of 80V-110V.

Explanation of Second Aspect of the Invention

A feature of the method of driving the information display device according to the second aspect of the invention is that, in the image display device having the construction mentioned above, use is made of a pulse voltage which is composed of a plurality of voltages consisting of a driving voltage V generating an ON state and a voltage $V_0$ of not larger than a threshold value, at which the display media start to move, generating an OFF state, while, in the known driving method, the driving voltage V generating an ON state is continuously applied so as to display an image. In other words, a new concept such as a period of OFF state (OFF period), in which the voltage $V_0$ of not larger than a threshold value, is used so that the cross-talk is reduced by controlling the OFF period. In this case, $V_0$ and V may be composed of a plurality of voltage levels respectively and they may be varied gradually.

Figure 10:
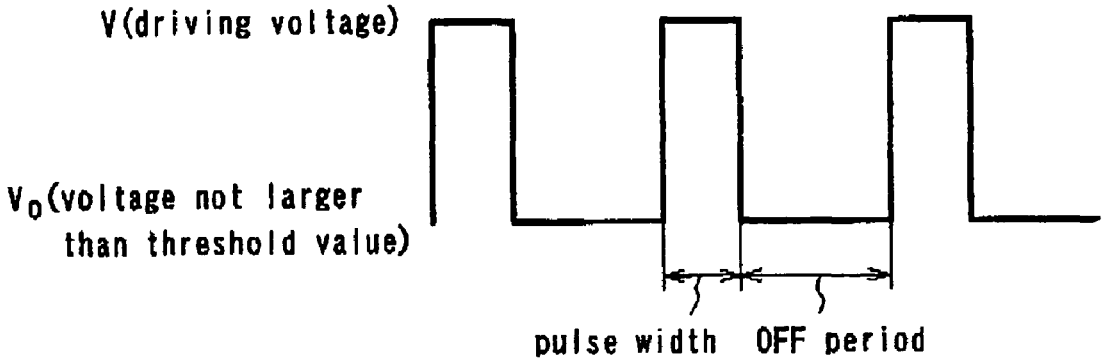
FIG. 10 is a schematic view showing one embodiment of a pulse voltage used in the method of driving the information display device according to the second aspect of the invention.

FIG. 10 is a schematic view showing one embodiment of a pulse voltage used for the method of driving the information display device according to the second aspect of the invention. In the embodiment shown in FIG. 10, the pulse voltage used in the present invention is composed of the driving voltage generating the ON state and the voltage of not larger than a threshold value ($V_1$), at which the display media start to move, generating the OFF state. In addition, in a preferred embodiment of the invention, there are cases: such that a duty ratio (=pulse width/(pulse width+period of the OFF state)) of the pulse voltage is not larger than 0.9; and such that a period of the OFF state is not less than 0.1 msec. Both embodiments will be explained in detail in the examples mentioned below.

Explanation of Third Aspect of the Invention

A feature of the method of driving the image display device according to the third aspect of the invention is that, in the image display device having the construction mentioned above, a cross-talk voltage waveform is further investigated in detail in the case of applying various driving methods, and the most suitable method is selected, so that a contrast is improved. Specifically, when a pixel rewriting operation is performed once, a plurality of pulses are applied, and, a pulse waveform of the driving voltage is controlled in such a manner that a polarity of a cross-talk voltage applied to a non-rewriting pixel is not changed, i.e. in such a manner that a pulse of the cross-talk voltage applied as a difference between the row (scan) driving voltage and the column voltage in the non-rewriting pixel does not lie in a region bridging both polarities of positive and negative, and, in other words, in such a manner that it lies only in the positive region if a polarity is passive and it lies only in the negative region if a polarity is negative.

Figure 11:
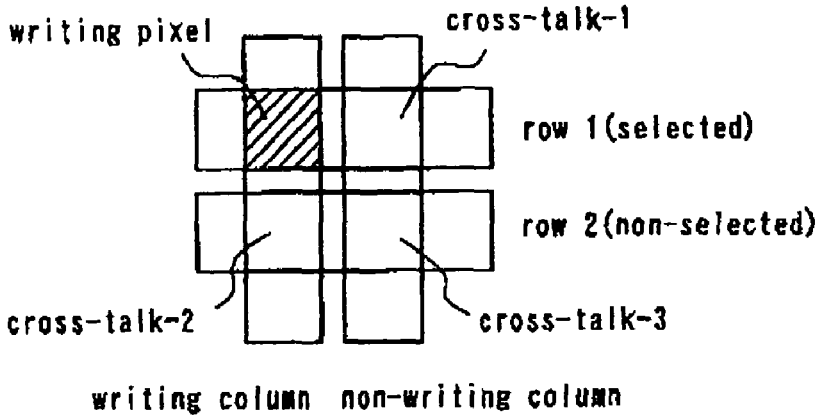
FIGS. 11*a* and 11*b* are schematic views respectively illustrating a row 1 selected state and a row 2 selected state in a passive matrix of 2 rows and 2 columns (third aspect of the invention).
Figure 11:
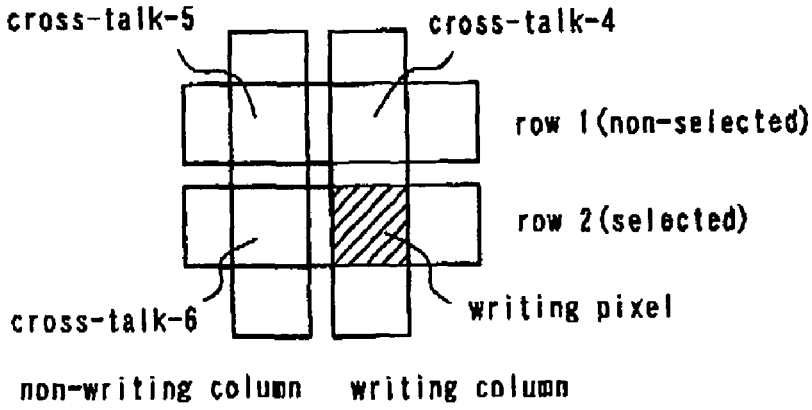

FIGS. 11*a* and 11*b* are schematic views respectively showing a row 1 selected state and a row 2 selected state in a passive matrix of 2 rows and 2 columns. In the embodiments shown in FIGS. 11*a* and 11*b*, if a rewriting voltage is applied to a pixel to be rewrote (hatched area in the figure), three kinds of cross-talk voltages such as cross-talk −1 to −3 shown in the figure are applied. If the number of rows is increased, there are only two kinds of voltages mentioned above (two kinds of row selected state and row non-selected state, two kinds of column rewriting state and column non-rewriting state, thus two kinds in 2×2). If use is made of more complex driving logic, further more kinds of voltages exist). In the case such that the cross-talk voltage is not 0V, an image quality is deteriorated (in the case of black and white display) in such a manner that, if the non-rewriting pixel is for example black, it becomes whity black (gray), and, if the non-rewriting pixel is for example white, it becomes blackish white (gray). In the case of using the image display device having an image memory characteristic, it is necessary to perform a writing operation (sometimes equal to a deleting operation) by inversing a polarity of the applied voltage.

Moreover, as a preferred embodiment of the method of driving the information display device according to the third aspect of the invention, a display color of the rewriting pixel can be made black in addition to the contrast improvement mentioned above by widening a peak-to-peak distance of the pulse voltages applied to the rewriting pixel, during the period for which a plurality of pulses are applied when the pixel rewriting operation is performed once, so that a contrast can be further improved. Specifically, a row (scan) driving voltage and a column driving voltage are composed of a pulse train with same cycle and same duty, and, when the pulse train at a row side is selected, a phase of the pulse train of the row driving voltage and the column driving voltage is inverted respectively. In this case, a difference of peak-to-peak can be made larger in the cross-talk voltage applied as a difference between the row (scan) driving voltage and the column driving voltage to the rewriting pixel, so that a color of the rewriting pixel can be made dark. Both embodiments will be explained in detail in the examples mentioned below.

Hereinafter, respective members constituting the information display panel, which is an object of the invention, will be explained.

As the substrate, at least one of the substrates is the transparent front substrate 2 through which a color of the particles or the liquid powders can be observed from outside of the device, and it is preferred to use a material having a high transmission factor of visible light and an excellent heat resistance. The rear substrate 1 may be transparent or may be opaque. Examples of the substrate material include polymer sheets such as polyethylene terephthalate, polyether sulfone, polyethylene, polycarbonate, polyimide or acryl and metal sheets having flexibility and inorganic sheets such as glass, quartz or so having no flexibility. The thickness of the substrate is preferably 2 to 5000 μm, more preferably 5 to 2000 μm. When the thickness is too thin, it becomes difficult to maintain strength and distance uniformity between the substrates, and when the thickness is thicker than 5000 μm, there is a drawback as a thin-type information display panel.

As a material of the electrode in the case of arranging the electrode on the information display panel, use is made of metals such as aluminum, silver, nickel, copper, gold, or, conductive metal oxides such as ITO, indium oxide, conductive tin oxide, conductive zinc oxide and so on, or, conductive polymers such as polyaniline, polypyrrole, polythiophene and so on, and they are used by being suitably selected. As an electrode forming method, use is made of a method in which the materials mentioned above are made to a thin film by means of sputtering method, vacuum vapor deposition method, CVD (chemical vapor deposition) method, coating method and so on, or, a method in which conductive materials and solvents are mixed with synthetic resin binder and the mixture is sprayed. A transparency is necessary for the electrode arranged to the substrate at an observation side (display surface side), but it is not necessary to the substrate at a rear side. In both cases, the materials mentioned above, which are transparent and have a pattern formation capability, can be suitably used. Additionally, the thickness of the electrode may be suitable unless the electro-conductivity is absent or any hindrance exists in optical transparency, and it is preferable to be 3 to 1000 nm, more preferable to be 5 to 400 nm. The material and the thickness of the electrode arranged to the rear substrate are the same as those of the electrode arranged to the substrate at the display side, but transparency is not necessary. In this case, the applied outer voltage may be superimposed with a direct current or an alternate current.

As the partition wall 4 arranged according to need, a shape of the partition wall is suitably designed in accordance with a kind of the display media used for the display and is not restricted. However, it is preferred to set a width of the partition wall to 2-100 μm more preferably 3-50 μm and to set a height of the partition wall to 10-500 μm more preferably 10-200 μm. Moreover, as a method of forming the partition wall, use may be made of a double rib method wherein ribs are formed on the opposed substrates respectively and they are connected with each other and a single rib method wherein a rib is formed on one of the opposed substrates only. The present invention may be preferably applied to both methods mentioned above.

Figure 12:
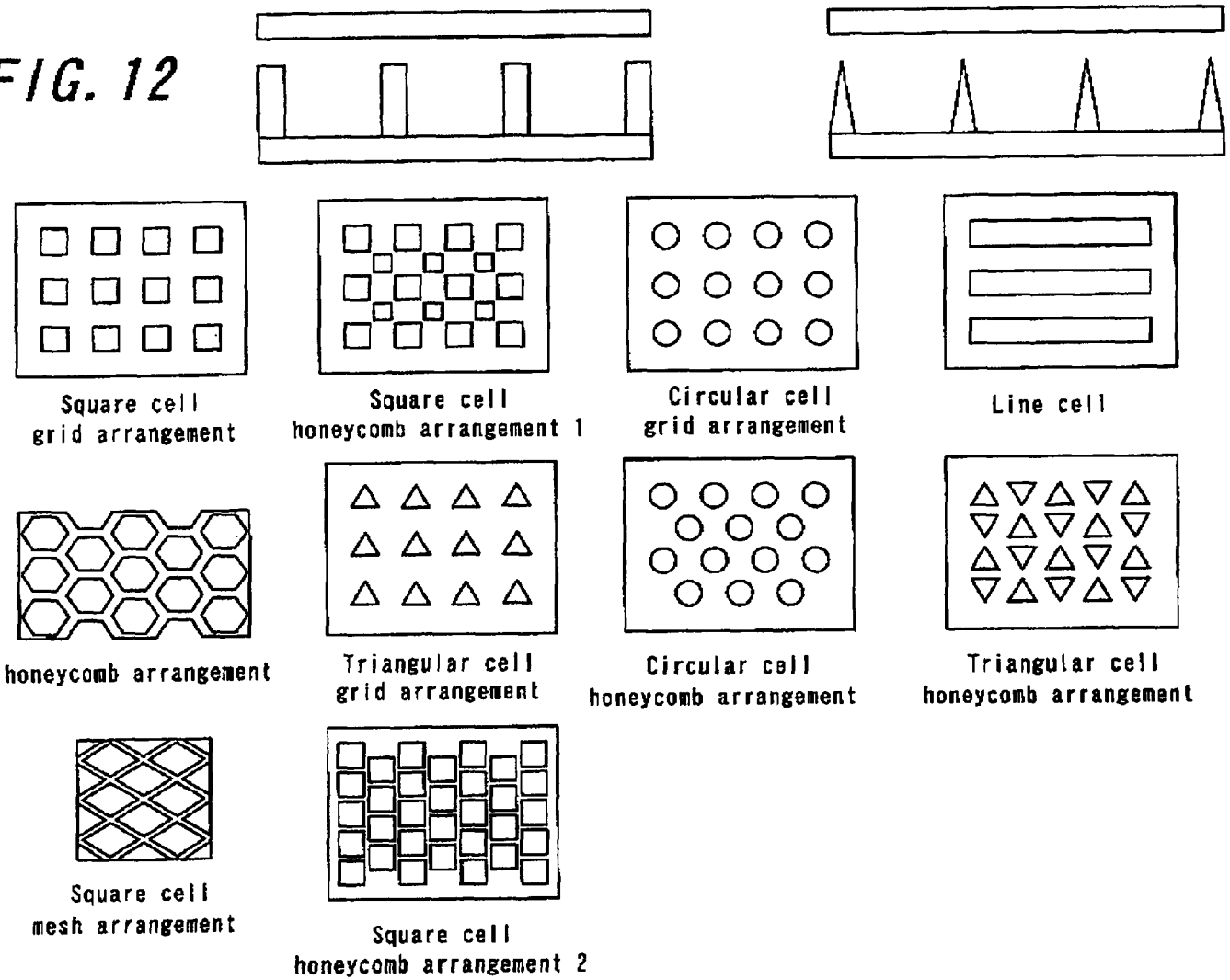
FIG. 12 is a schematic view showing one embodiment of a shape of the partition walls in the information display device according to the invention.

The cell formed by the partition walls each made of rib has a square shape, a triangular shape, a line shape, a circular shape and a hexagon shape, and has an arrangement such as a grid, a honeycomb and a mesh, as shown in FIG. 12 viewed from a plane surface of the substrate. It is preferred that the portion corresponding to a cross section of the partition wall observed from the display side (an area of the frame portion of the cell) should be made as small as possible. In this case, a clearness of the image display can be improved. The formation method of the partition wall is not particularly restricted, however, a die transfer method, a screen-printing method, a sandblast method, a photolithography method and an additive method. Among them, it is preferred to use a photolithography method using a resist film or a die transfer method.

Then, the particles as the display media used in the information display panel according to the invention will be explained. The particle constituting the particles may be composed of resins as a main ingredient, and can include according to need charge control agents, coloring agent, inorganic additives and so on as is the same as the known one. Hereinafter, typical examples of resin, charge control agent, coloring agent, additive and so on will be explained.

Typical examples of the resin include urethane resin, urea resin, acrylic resin, polyester resin, acryl urethane resin, acryl urethane silicone resin, acryl urethane fluorocarbon polymers, acryl fluorocarbon polymers, silicone resin, acryl silicone resin, epoxy resin, polystyrene resin, styrene acrylic resin, polyolefin resin, butyral resin, vinylidene chloride resin, melamine resin, phenolic resin, fluorocarbon polymers, polycarbonate resin, polysulfon resin, polyether resin, and polyamide resin. Two kinds or more of these may be mixed and used. For the purpose of controlling the attaching force with the substrate, acryl urethane resin, acryl silicone resin, acryl fluorocarbon polymers, acryl urethane silicone resin, acryl urethane fluorocarbon polymers, fluorocarbon polymers, silicone resin are particularly preferable.

Examples of the electric charge control agent include, but not particularly specified to, negative charge control agent such as salicylic acid metal complex, metal containing azo dye, oil-soluble dye of metal-containing (containing a metal ion or a metal atom), the fourth grade ammonium salt-based compound, calixarene compound, boron-containing compound (benzyl acid boron complex), and nitroimidazole derivative. Examples of the positive charge control agent include nigrosine dye, triphenylmethane compound, the fourth grade ammonium salt compound, polyamine resin, imidazole derivatives, etc. Additionally, metal oxides such as ultra-fine particles of silica, ultra-fine particles of titanium oxide, ultra-fine particles of alumina, and so on; nitrogen-containing circular compound such as pyridine, and so on, and these derivates or salts; and resins containing various organic pigments, fluorine, chlorine, nitrogen, etc. can be employed as the electric charge control agent.

As for a coloring agent, various kinds and colors of organic or inorganic pigments or dye as will be described below are employable.

Examples of black pigments include carbon black, copper oxide, manganese dioxide, aniline black, and activate carbon.

Examples of blue pigments include C.I. pigment blue 15:3, C.I. pigment blue 15, Berlin blue, cobalt blue, alkali blue lake, Victoria blue lake, phthalocyanine blue, metal-free phthalocyanine blue, partially chlorinated phthalocyanine blue, first sky blue, and Indanthrene blue BC.

Examples of red pigments include red oxide, cadmium red, diachylon, mercury sulfide, cadmium, permanent red 4R, lithol red, pyrazolone red, watching red, calcium salt, lake red D, brilliant carmine 6B, eosin lake, rhodamine lake B, alizarin lake, brilliant carmine 3B, and C.I. pigment red 2.

Examples of yellow pigments include chrome yellow, zinc chromate, cadmium yellow, yellow iron oxide, mineral first yellow, nickel titanium yellow, navel orange yellow, naphthol yellow S, hansayellow G, hansayellow 10G, benzidine yellow G, benzidine yellow GR, quinoline yellow lake, permanent yellow NCG, tartrazine lake, and C.I. pigment yellow 12.

Examples of green pigments include chrome green, chromium oxide, pigment green B, C.I. pigment green 7, Malachite green lake, and final yellow green G.

Examples of orange pigments include red chrome yellow, molybdenum orange, permanent orange GTR, pyrazolone orange, Balkan orange, Indanthrene brilliant orange RK, benzidine orange G, Indanthrene brilliant orange GK, and C.I. pigment orange 31.

Examples of purple pigments include manganese purple, first violet B, and methyl violet lake.

Examples of white pigments include zinc white, titanium oxide, antimony white, and zinc sulphide.

Examples of extenders include baryta powder, barium carbonate, clay, silica, white carbon, talc, and alumina white. Furthermore, there are Nigrosine, Methylene Blue, rose bengal, quinoline yellow, and ultramarine blue as various dyes such as basic dye, acidic dye, dispersion dye, direct dye, etc.

Examples of inorganic additives include titanium oxide, zinc white, zinc sulphide, antimony oxide, calcium carbonate, pearl white, talc, silica, calcium silicate, alumina white, cadmium yellow, cadmium red, titanium yellow, Pressian blue, Armenian blue, cobalt blue, cobalt green, cobalt violet, ion oxide, carbon black, manganese ferrite black, cobalt ferrite black, copper powder, aluminum powder.

These coloring agents and inorganic additives may be used alone or in combination of two or more kinds thereof. Particularly, carbon black is preferable as the black coloring agent, and titanium oxide is preferable as the white coloring agent.

Moreover, as the average particle diameter d(0.5) of the particles to be used, it is preferred to set d(0.5) to 0.1-20 μm and to use even particles. If the average particle diameter d(0.5) exceeds this range, the image clearness sometimes deteriorated, and, if the average particle diameter is smaller than this range, an agglutination force between the particles becomes too large and the movement of the particles is prevented.

Further, it is preferred that particle diameter distribution Span of the particles, which is defined by the following formula, is less 5 preferably less than 3:

$$\text{Span}=(d(0.9)-d(0.1))/d(0.5);$$

(here, d(0.5) means a value of the particle diameter expressed by μm wherein an amount of the particles having the particle diameter larger than or smaller than this value is 50%, d(0.1) means a value of the particle diameter expressed by μm wherein an amount of the particles having the particle diameter smaller than this value is 10%, and d(0.9) means a value of the particle diameter expressed by μm wherein an amount of the particles having the particle diameter smaller than this value is 90%).

If the particle diameter distribution Span of the particles is set to not more than 5, the particle diameter becomes even and it is possible to perform an even particle movement.

Furthermore, as a correlation between the particles, it is preferred to set a ratio of d(0.5) of the particles having smallest diameter with respect to d(0.5) of the particles having largest diameter to not more than 50 preferably not more than 10. The particles having different charge characteristics with each other are moved reversely, even if the particle diameter distribution Span is made smaller. Therefore, it is preferred that the particle sizes of the particles are made to be even with each other, and same amounts of the particles are easily moved in a reverse direction, and thus that is this range.

Here, the particle diameter distribution and the particle diameter mentioned above can be measured by means of a laser diffraction/scattering method. When a laser light is incident upon the particles to be measured, a light intensity distribution pattern due to a diffraction/scattering light occurs spatially. This light intensity distribution pattern corresponds to the particle diameter, and thus it is possible to measure the particle diameter and the particle diameter distribution.

In the present invention, it is defined that the particle diameter and the particle diameter distribution are obtained by a volume standard distribution. Specifically, the particle diameter and the particle diameter distribution can be measured by means of a measuring apparatus Mastersizer 2000 (Malvern Instruments Ltd.) wherein the particles setting in a nitrogen gas flow are calculated by an installed analysis software (which is based on a volume standard distribution due to Mie's theory).

A charge amount of the display media properly depends upon the measuring condition. However, it is understood that the charge amount of the display media used for the display media in the information display panel substantially depends upon an initial charge amount, a contact with respect to the partition wall, a contact with respect to the substrate, a charge decay due to an elapsed time, and specifically a saturation value of the particles for the display media during a charge behavior is a main factor.

After various investigations of the inventors, it is fond that an adequate range of the charged values of the particles for the display media can be estimated by performing a blow-off method utilizing the same carrier particles so as to measure the charge amount of the particles for the display media.

Then, liquid powders including at least the white color particles according to the invention will be explained. It should be noted that a right of the name of liquid powders used in the information display panel according to the invention is granted to the applicant as "liquid powders" (Registered): register No. 4636931.

In the present invention, a term "liquid powders" means an intermediate material having both of liquid properties and particle properties and exhibiting a self-fluidity without utilizing gas force and liquid force. Preferably, it is a material having an excellent fluidity such that there is no repose angle defining a fluidity of powder. For example, a liquid crystal is defined as an intermediate phase between a liquid and a solid, and has a fluidity showing a liquid characteristic and an anisotropy (optical property) showing a solid characteristic (Heibonsha Ltd.: encyclopedia). On the other hand, a definition of the particle is a material having a finite mass if it is vanishingly small and receives an attraction of gravity (Maruzen Co., Ltd.: physics subject-book). Here, even in the particles, there are special states such as gas-solid fluidized body and liquid-solid fluidized body. If a gas is flown from a bottom plate to the particles, an upper force is acted with respect to the particles in response to a gas speed. In this case, the gas-solid fluidized body means a state that is easily fluidized when the upper force is balanced with the gravity. In the same manner, the liquid-solid fluidized body means a state that is fluidized by a liquid. (Heibonsha Ltd.: encyclopedia) In the present invention, it is found that the intermediate material having both of fluid properties and solid properties and exhibiting a self-fluidity without utilizing gas force and liquid force can be produced specifically, and this is defined as the liquid powders.

That is, as is the same as the definition of the liquid crystal (intermediate phase between a liquid and a solid), the liquid powders according to the invention are a material showing the intermediate state having both of liquid properties and particle properties, which is extremely difficult to receive an influence of the gravity showing the particle properties mentioned above and indicates a high fluidity. Such a material can be obtained in an aerosol state i.e. in a dispersion system wherein a solid-like or a liquid-like material is floating in a relatively stable manner as a dispersant in a gas, and thus, in the information display panel according to the invention, a solid material is used as a dispersant.

The information display panel which is a target of the present invention has a construction such that the liquid powders composed of a solid material stably floating as a dispersoid in a gas and exhibiting a high fluidity in an aerosol state are sealed between opposed two substrates, wherein one of two substrates is transparent. Such liquid powders can be made to move easily and stably by means of Coulomb's force and so on generated by applying a low voltage.

As mentioned above, the liquid powders means an intermediate material having both of liquid properties and particle properties and exhibiting a self-fluidity without utilizing gas force and liquid force. Such liquid powders become particularly an aerosol state. In the information panel according to the invention, the liquid powders used in a state such that a solid material is relatively and stably floating as a dispersoid in a gas.

As the aerosol state, it is preferred that an apparent volume in a maximum floating state is two times or more than that in none floating state, more preferably 2.5 times or more than that in none floating state, and most preferably three times or more than that in none floating state. In this case, an upper limit is not defined, but it is preferred that an apparent volume is 12 times or smaller than that in none floating state.

If the apparent volume in the maximum floating state is smaller than two times, a display controlling becomes difficult. On the other hand, if the apparent volume in the maximum floating state is larger than 12 times, a handling inconvenience during a liquid powders filling operation into the device such as a particle over-scattering occurs. That is, it is measured by filling the liquid powders in a transparent closed vessel through which the liquid powders are seen; vibrating or dropping the vessel itself to obtain a maximum floating state; and measuring an apparent volume at that time from outside of the vessel. Specifically, the liquid powders having a volume ⅕ of the vessel are filled as the liquid powders in a polypropylene vessel with a cap having a diameter (inner diameter) of 6 cm and a height of 10 cm (product name I-boy produced by As-one Co., Ltd.), the vessel is set in the vibrator, and a vibration wherein a distance of 6 cm is repeated at a speed of 3 reciprocating/sec. is performed for 3 hours. Then, the apparent volume in the maximum floating state is obtained from an apparent volume just after a vibration stop.

Moreover, according to the invention, it is preferred that a time change of the apparent volume of the liquid powders satisfies the following formula:

$$V_{10}/V_5>0.8;$$

here, $V_5$ indicates the apparent volume ($cm^3$) of the liquid powders after 5 minutes from the maximum floating state; and $V_{10}$ indicates the apparent volume ($cm^3$) of the liquid powders after 10 minutes from the maximum floating state. In this case, in the information display panel according to the invention, it is preferred to set the time change $V_{10}/V_5$ of the apparent volume of the liquid powders to larger than 0.85, more preferably larger than 0.9. If the time change $V_{10}/V_5$ is not larger than 0.8, the liquid powders are substantially equal to normal particles, and thus it is not possible to maintain a high speed response and durability according to the invention.

Moreover, it is preferred that the average particle diameter d(0.5) of the particle materials constituting the liquid powders is 0.1-20 μm, more preferably 0.5-15 μm, most preferably 0.9-8 μm. If the average particle diameter d(0.5) is less than 0.1 μm, a display controlling becomes difficult. On the other hand, if the average particle diameter d(0.5) is larger than 20 μm, a display clearness becomes deteriorated. Here, the average particle diameter d(0.5) of the particle materials constituting the liquid powders is equal to d(0.5) in the following particle diameter distribution Span.

It is preferred that particle diameter distribution Span of the particle material constituting the liquid powders, which is defined by the following formula, is less than 5 preferably less than 3;

$$\text{Particle diameter distribution: Span}=(d(0.9)-d(0.1))/d(0.5);$$

here, d(0.5) means a value of the particle diameter expressed by μm wherein an amount of the particle material constituting the liquid powders having the particle diameter larger than this value is 50% and an amount of the particle material constituting the liquid powders having the particle diameter expressed by μm wherein an amount of the particle material constituting the liquid powders having a particle diameter smaller than this value is 10%, and d(0.9) means a value of the particle diameter expressed by μm wherein an amount of the particle material constituting the liquid powders having the particle diameter smaller than this value is 90%. If the particle diameter distribution Span of the particle materials constituting the liquid powders is set to not more than 5, the particle diameter becomes even and it is possible to perform an even liquid powders movement.

Here, the particle diameter distribution and the particle diameter mentioned above can be measured by means of a laser diffraction/scattering method. When a laser light is incident upon the particles to be measured, a light intensity distribution pattern due to a diffraction/scattering light occurs spatially. This light intensity distribution pattern corresponds to the particle diameter, and thus it is possible to measure the particle diameter and the particle diameter distribution. In the present invention, it is defined that the particle diameter and the particle diameter distribution are obtained by a volume standard distribution. Specifically, the particle diameter and the particle diameter distribution can be measured by means of a measuring apparatus Mastersizer 2000 (Malvern Instruments Ltd.) wherein the particles setting in a nitrogen gas flow are calculated by an installed analysis software (which is based on a volume standard distribution due to Mie's theory).

The liquid powders may be formed by mixing necessary resin, charge control agent, coloring agent, additive and so on and crushing them, or, by polymerizing from monomer, or, by coating a particle with resin, charge control agent, coloring agent, and additive and so on. Hereinafter, typical examples of resin, charge control agent, coloring agent, additive and so on constituting the liquid powders will be explained.

Typical examples of the resin include urethane resin, acrylic resin, polyester resin, modified acryl urethane resin, silicone resin, nylon resin, epoxy resin, styrene resin, butyral resin, vinylidene chloride resin, melamine resin, phenolic resin, fluorocarbon polymers, and it is possible to combine two or more resins. For the purpose of controlling the attaching force with the substrate, acryl urethane resin, acryl urethane silicone resin, acryl urethane fluorocarbon polymers, urethane resin, fluorocarbon polymers are preferred.

Examples of the charge control agent include, positive charge control agent including the fourth grade ammonium salt compound, nigrosine dye, triphenylmethane compound, imidazole derivatives, and so on, and negative charge control agent such as metal containing azo dye, salicylic acid metal complex, nitroimidazole derivative and so on.

As for a coloring agent, various kinds and colors of organic or inorganic pigments or dye are employable.

Examples of black pigments include carbon black, copper oxide, manganese dioxide, aniline black, and activate carbon.

Examples of blue pigments include C.I. pigment blue 15:3, C.I. pigment blue 15, Berlin blue, cobalt blue, alkali blue lake, Victoria blue lake, phthalocyanine blue, metal-free phthalocyanine blue, partially chlorinated phthalocyanine blue, first sky blue, and Indanthrene blue BC.

Examples of red pigments include red oxide, cadmium red, diachylon, mercury sulfide, cadmium, permanent red 4R, lithol red, pyrazolone red, watching red, calcium salt, lake red D, brilliant carmine 6B, eosin lake, rhodamine lake B, alizarin lake, brilliant carmine 3B, and C.I. pigment red 2.

Examples of yellow pigments include chrome yellow, zinc chromate, cadmium yellow, yellow iron oxide, mineral first yellow, nickel titanium yellow, navel orange yellow, naphthol yellow S, hansayellow G, hansayellow 10G, benzidine yellow G, benzidine yellow GR, quinoline yellow lake, permanent yellow NCG, tartrazine lake, and C.I. pigment yellow 12.

Examples of green pigments include chrome green, chromium oxide, pigment green B, C.I. pigment green 7, Malachite green lake, and final yellow green G.

Examples of orange pigments include red chrome yellow, molybdenum orange, permanent orange GTR, pyrazolone orange, Balkan orange, Indanthrene brilliant orange RK, benzidine orange G, Indanthrene brilliant orange GK, and C.I. pigment orange 31.

Examples of purple pigments include manganese purple, first violet B, and methyl violet lake.

Examples of white pigments include zinc white, titanium oxide, antimony white, and zinc sulphide.

Examples of extenders include baryta powder, barium carbonate, clay, silica, white carbon, talc, and alumina white. Furthermore, there are Nigrosine, Methylene Blue, rose bengal, quinoline yellow, and ultramarine blue as various dyes such as basic dye, acidic dye, dispersion dye, direct dye, etc.

Examples of inorganic additives include titanium oxide, zinc white, zinc sulphide, antimony oxide, calcium carbonate, pearl white, talc, silica, calcium silicate, alumina white, cadmium yellow, cadmium red, titanium yellow, Pressian blue, Armenian blue, cobalt blue, cobalt green, cobalt violet, ion oxide, carbon black, manganese ferrite black, cobalt ferrite black, copper powder, aluminum powder.

These coloring agents and inorganic additives may be used alone or in combination of two or more kinds thereof. Particularly, carbon black is preferable as the black coloring agent, and titanium oxide is preferable as the white coloring agent.

However, if the above materials are only mixed or coated with no contrivance, the liquid powders exhibiting an aerosol state cannot be obtained. The regular method of forming the liquid powders exhibiting an aerosol state is not defined, but the following method is preferably used.

At first, inorganic fine particles having an average particle size of 20-100 nm preferably 20-80 nm are preferably fixed on a surface of materials constituting the liquid powders. Moreover, it is preferred that the inorganic fine particles are made of tow or more groups of fine particles. Further, it is preferred to treat the inorganic fine particles by silicone oil. Here, as for the inorganic fine particles, use may be made of silicon dioxide (silica), zinc oxide, aluminum oxide, magnesium oxide, cerium oxide, ferric oxide, copper oxide and so on. In this case, a method of fixing the inorganic fine particles is important. For example, use may be made of hybridizer (NARA Machinery Industry Co., Ltd.) or mechano-fusion (Hosokawa Micron Co., Ltd.), and the liquid powders showing an aerosol state are formed under a predetermined condition (for example processing time).

Further, in the present invention, it is important to control a gas in a gap surrounding the particles and liquid powders between the substrates, and a suitable gas control contributes an improvement of display stability. Specifically, it is important to control a humidity of the gap gas to not more than 60% RH at 25° C., preferably not more than 50% RH, more preferably not more than 35% RH.

The above gap means a gas portion surrounding the display media obtained by substituting the electrodes 5, 6, an occupied portion of the display media 3, an occupied portion of the partition walls 4 and a seal portion of the device from the space between the substrate 1 and the substrate 2 for example in FIGS. 1*a* and 1*b*-FIGS. 3*a* and 3*b*.

A kind of the gap gas is not limited if it has the humidity mentioned above, but it is preferred to use dry air, dry nitrogen gas, dry argon gas, dry helium gas, dry carbon dioxide gas, dry methane gas and so on. It is necessary to seal this gas in the device so as to maintain the humidity mentioned above. For example, it is important to perform the operations of filling the particles or liquid powders and assembling the substrate under an atmosphere having a predetermined humidity and to apply a seal member and a seal method for preventing a humidity inclusion from outside of the device.

In the information display panel according to the invention, an interval between the substrates is not restricted if the display media can be moved and a contrast can be maintained, and it is adjusted normally to 10-500 μm, preferably 10-200 μm.

Moreover, it is preferred to control a volume occupied rate of the display media in a space between the opposed substrates to 5-70%, more preferably 5-60%. If the volume occupied rate of the particles or the liquid powders exceeds 70%, the display media become difficult to move, and if it is less than 5%, a sufficient contrast cannot be obtained and a clear image display is not performed.

EMBODIMENTS

Hereinafter, the present invention will be explained further specifically with reference to the examples according to the second and third aspects of the invention, but the present invention is not limited to the following examples.

(Examples of the Second Aspect of the Invention)

<As to Margins of the Contrast and the Driving Voltage>

As an index for evaluating the method of driving the information display device according to the second aspect of the invention, margins of the contrast and the driving voltage were defined by performing the following experiment.

1. Experimental Method

In order to measure an effect of the cross-talk, reflectance of a display state was measured by varying a voltage in a method such that a most simple test pattern was displayed by using various driving methods.

1.1. Test Pattern

Figure 13:
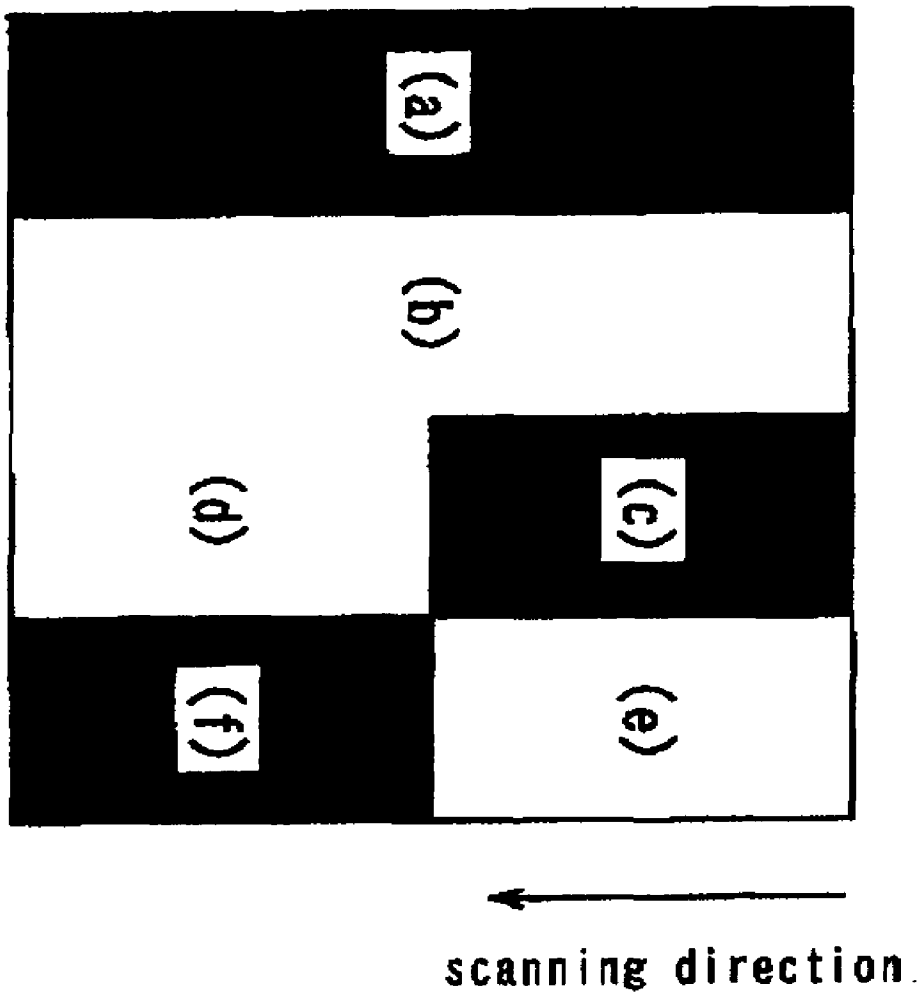
FIG. 13 is a schematic view illustrating one embodiment of a test pattern displayed by a passive matrix driving (second aspect of the invention).

The test pattern displayed by a passive matrix driving method is shown in FIG. 13. In FIG. 13, (a) is a solid black pattern region, (b) is a solid white pattern region and (c)-(f) are regions being influenced by the cross-talk. Detail explanation will be explained in the next section.

1.2. Explanation of Typical Reflectance-Applied Voltage Characteristic

Figure 14:
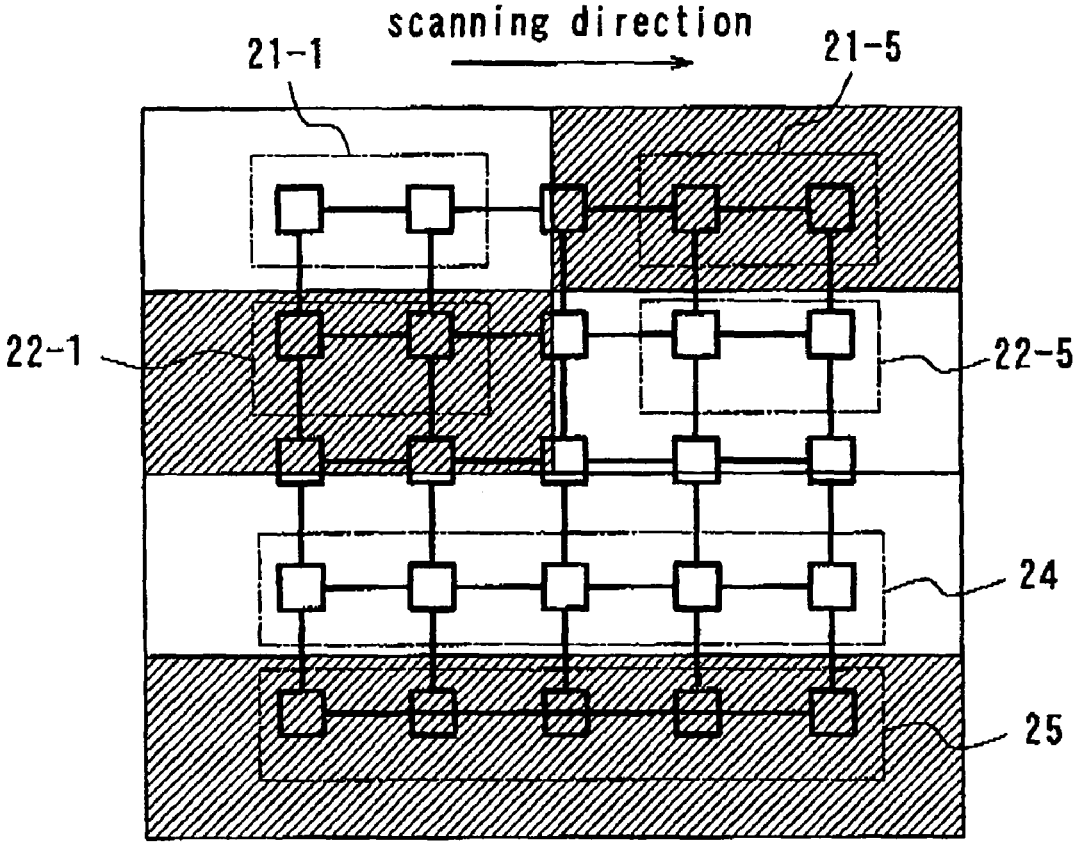
FIG. 14 is a schematic view depicting a display screen and a measuring region when the test pattern is displayed actually (second aspect of the invention).
Figure 15:
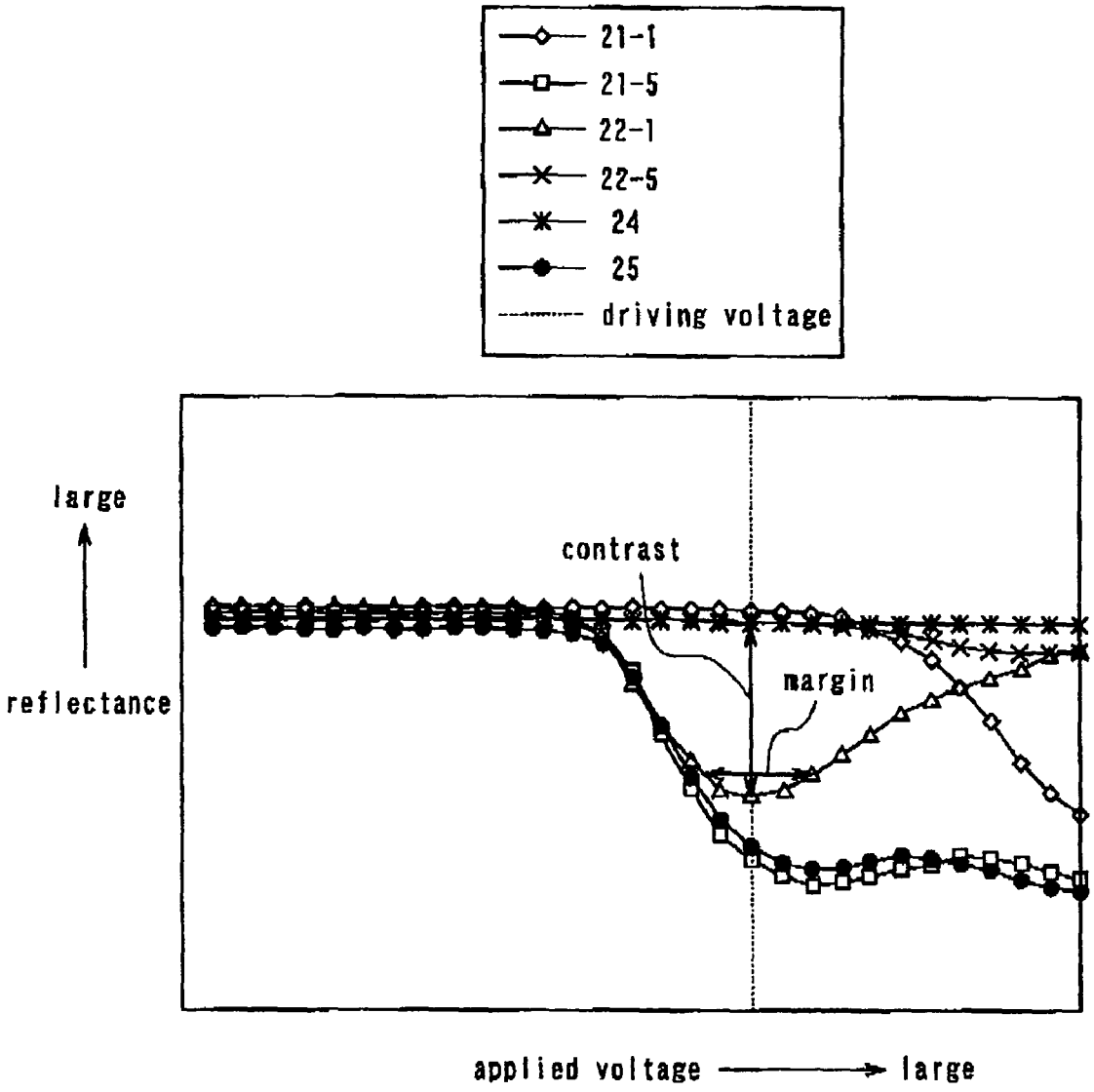
FIG. 15 is a graph showing a relation between an applied voltage and a reflectance measured in respective regions shown in FIG. 14 (second aspect of the invention).

FIG. 14 shows a display screen on which the test pattern is displayed, and FIG. 15 illustrates a measured typical reflectance-applied voltage characteristic. 5×5 measuring points were allocated as shown in FIG. 14, and reflectance at respective points was measured under such a condition that the test pattern was displayed by applying a writing voltage, which is gradually increased from 0V. In this case, reflectance of respective regions was determined as an average value of respective square portions, and, in FIG. 15, a characteristic curve was indicated in a graph, whose abscissa axis is the applied voltage and whose longitudinal axis is reflectance. Hereinafter, respective lines shown in FIG. 15 will be explained. It should be noted that the matrix driving method is performed in the manner shown in the following Table 1. Moreover, a potential difference is described in such a manner that a potential applied to an electrode at a column side is assumed to be +. For example, if a voltage of 0V is applied to column side and a voltage of 50V is applied to a row side, a potential difference between electrodes is −50V.

TABLE 1

| | | Deleting | Writing |
|---|---|---|---|
| Row | Selected | V | 0 |
| | Non-selected | 0 | V/2 |
| Column | Selected | 0 | V |
| | Non-selected | 0 | 0 |

(1) Region 21-1

When the row is selected, a voltage of 0(V) is applied, and, when the row is not selected, a voltage of −V/2 is applied during a front half of the scanning operation and a cross-talk voltage of V/2 is applied during a back half of the scanning operation. The row of this region is selected at a front half of the scanning operation, but, if the applied voltage is made larger, it is largely affected by the cross-talk generating during the back half of the scanning operation. Therefore, a white color display of this region is not maintained and is transferred to a black color display.

(2) Region 21-5

When the row is selected, a voltage of V is applied, and, when the row is not selected, a voltage of −V/2 is applied during a front half of the scanning operation and a cross-talk voltage of V/2 is applied during a back half of the scanning operation. Since this region, which is selected during a back half of the scanning operation, is not affected by the cross-talk as such, it shows substantially same tendency as that of the region 5.

(3) Region 22-1

When the row is selected, a voltage of 0(V) is applied, and, when the row is not selected, a voltage of V/2 is applied during a front half of the scanning operation and a cross-talk voltage of −V/2 is applied during a back half of the scanning operation. The row of this region is selected at a front half of the scanning operation, but, if the applied voltage is made larger, it is largely affected by the cross-talk generating during the back half of the scanning operation. Therefore, a black color display of this region is not maintained and is transferred to a white color display.

(4) Region 22-5

When the row is selected, a voltage of 0(V) is applied, and, when the row is not selected, a voltage of V/2 is applied during a front half of the scanning operation and a cross-talk voltage of −V/2 is applied during a back half of the scanning operation. The row of this region is selected at a back half of the scanning operation, but, since a voltage of 0(V) is selected which is differed from the region 1-5, an affection of the cross-talk generating during a front half of the scanning operation remains. Therefore, if the applied voltage is made larger, a white color display of this region is not maintained and is transferred to a black color display.

(5) Region 24

When the row is selected, a voltage of 0(V) is applied, and, when the row is not selected, a voltage of −V/2 is always applied. Therefore, this region maintains a white color display, and this white color display is a standard of white color in various display method.

(6) Region 25

When the row is selected, a voltage of V is applied, and, when the row is not selected, a voltage of V/2 is always applied. Therefore, this region maintains a black color display, and this black color display is a standard of black color in various display method.

2. Evaluation Method

As an important evaluation item for performing a gray level display, there is a contrast. Most important region among respective regions is the region 22-1. No matter what a minimum reflectance of black color is low, since the region 22-1 is shifted to a white color side due to an influence of the cross-talk, a contrast is restricted by reflectance of this region. The cross-talk is largely affected even in the region 21-1, but a variation due to the cross-talk occurs at a high voltage side as compared with the region 22-1. Since an object is to obtain an excellent display in a lower voltage so as to reduce power consumption, the cross-talk of the region 21-1 is negligible.

Here, the evaluation method of this experiment is defined as follows.

(1) Contrast (Longitudinal Line with Double-Headed Arrow in FIG. 15)

Normal contrast is indicated as a ratio between maximum reflectance of a white color and minimum reflectance of a black color, but, in this experiment, it was defined as follows with taking into consideration of the items mentioned above.

That is, a contrast was defined as a ratio between reflectance of minimum (maximum: in the case of black deleting and white writing) level of a line 22-1 and reflectance of white (black: in the case of black deleting and white writing) display at that time. In this case, a term "black deleting and white writing" means "deleting-rewriting method" in which a deleting operation is performed in such a manner that a display state becomes black, and then a rewriting operation is performed in such a manner that a portion to be displayed as a white color becomes white. Contrary to this, "deleting-rewriting method" in which a deleting operation is performed in such a manner that a display state becomes white, and then a rewriting operation is performed in such a manner that a portion to be displayed as a black color becomes black is called as "white deleting and black writing". It should be noted that it is better to make a contrast higher.

(2) Margin of Driving Voltage (Lateral Line with Double-Headed Arrow in FIG. 15)

A margin of the driving voltage was defined as a width of the line 22-1, at which a difference on the line 22-1 between reflectance of minimum (maximum: in the case of black deleting and white writing) level and reflectance of white (black: in the case of black deleting and white writing) display is increased (decreased: in the case of black deleting and white writing) by 10%. It should be noted that it is better to make a margin wider.

<As to Pulse Driving Voltage>

A pulse driving voltage was investigated under the condition such that the contrast and the margin of the driving voltage defined as mentioned above were used as the indexes. In this experiment, it was assumed that a voltage $V_0$, which was not larger than a threshold value, was 0(V).

(1) As to Duty Ratio

Figure 16:
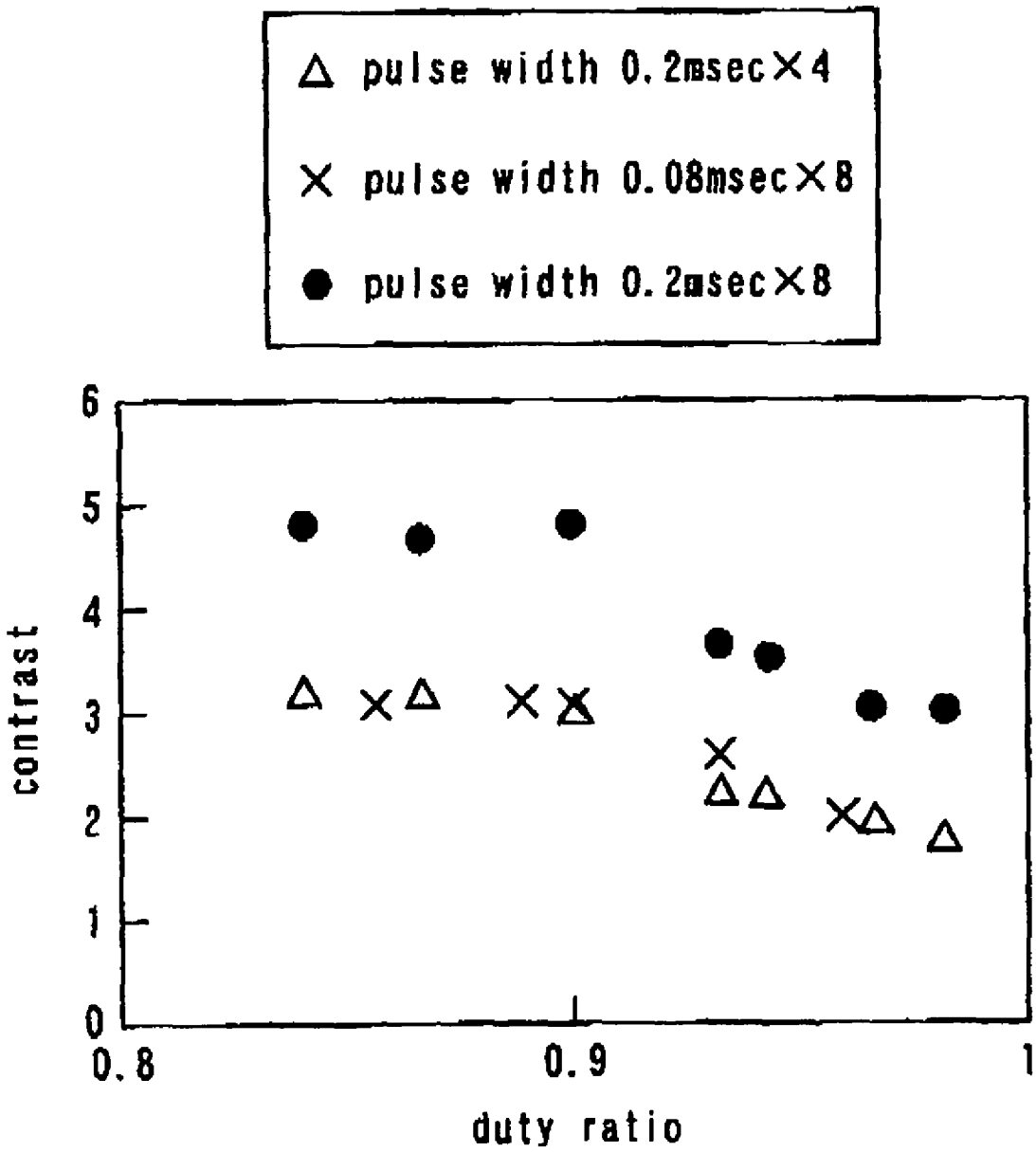
FIG. 16 is a graph illustrating a relation between a duty ratio and a contrast in a pulse driving voltage (second aspect of the invention).

At first, as the driving voltage, use was made of three kinds of pulse voltages such as four pulses each having a pulse width of 0.2 msec, eight pulses each having a pulse width of 0.08 msec and eight pulses each having a pulse width of 0.2 msec, and a contrast was measured when a duty ratio of respective pulse voltages was varied in various manner. The results are shown in FIG. 16. In FIG. 16, the duty ratio in an abscissa axis is indicated by a logarithm scale. From the results shown in FIG. 16, it is understood that a contrast is decreased, if the duty ratio exceeds 0.9, and that it is preferred to make the duty ratio as small as possible.

Figure 17:
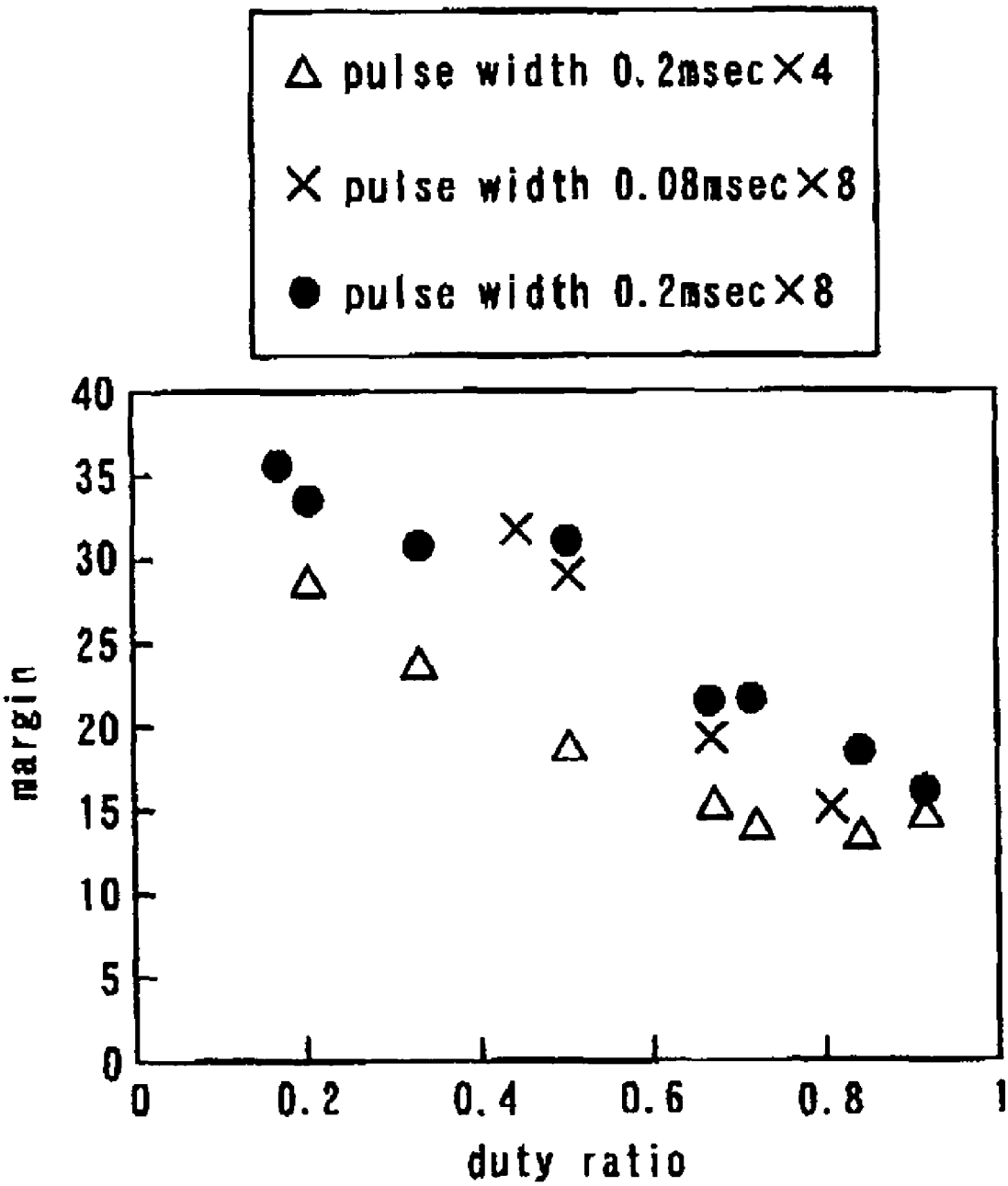
FIG. 17 is a graph depicting a relation between a duty ratio and a margin in a pulse driving voltage (second aspect of the invention).

Then, as the driving voltage, use was made of three kinds of pulse voltages such as four pulses each having a pulse width of 0.2 msec, eight pulses each having a pulse width of 0.08 msec and eight pulses each having a pulse width of 0.2 msec, and a margin was measured when a duty ratio of respective pulse voltages was varied in various manner. The results are shown in FIG. 17. From the results shown in FIG. 17, since the margin is larger if the duty ratio is smaller, it is understood that it is preferred to make the duty ratio as small as possible.

(2) As to OFF Period

Figure 18:
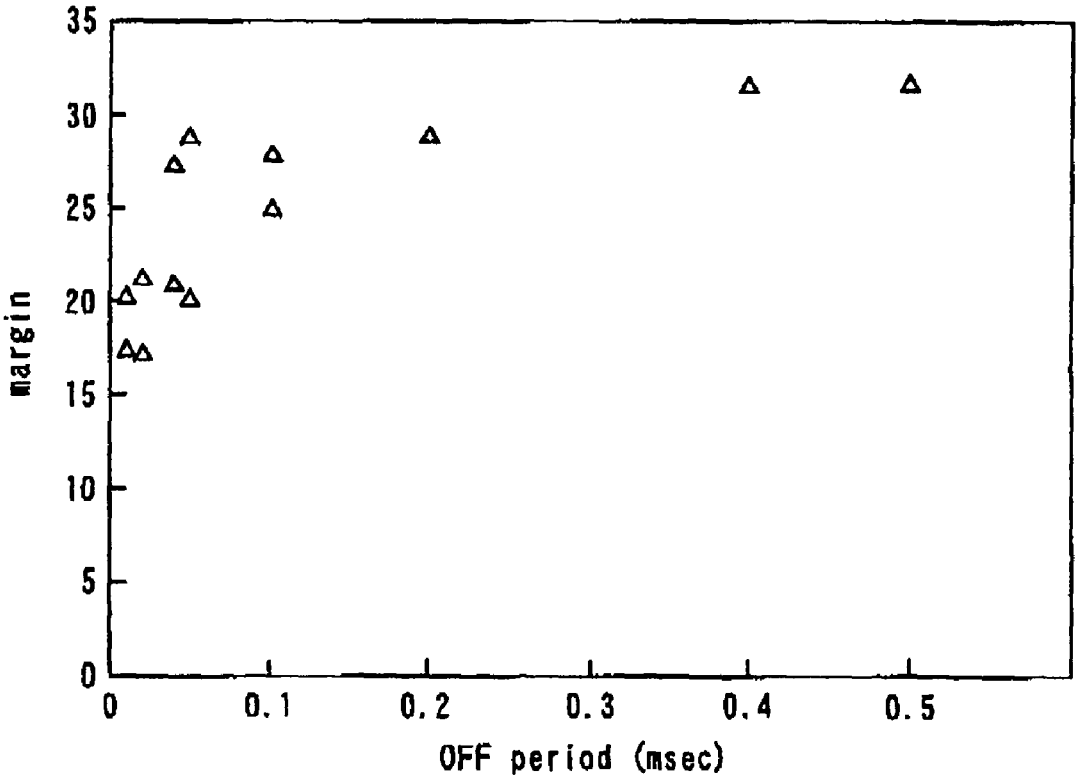
FIG. 18 is a graph showing a relation between an OFF period and a margin in a pulse driving voltage (second aspect of the invention).

On the basis of the data obtained about a relation between the duty ratio and the contrast or the margin mentioned above, a relation between an OFF period and the margin was investigated. The results are shown in FIG. 18. From the results shown in FIG. 18, it is understood that the margin becomes smaller if the OFF period is less than 0.1 msec, and thus it is understood that it is preferred to make the OFF period not less than 0.1 msec.

(Embodiments of the Third Aspect of the Invention)

Figure 19:
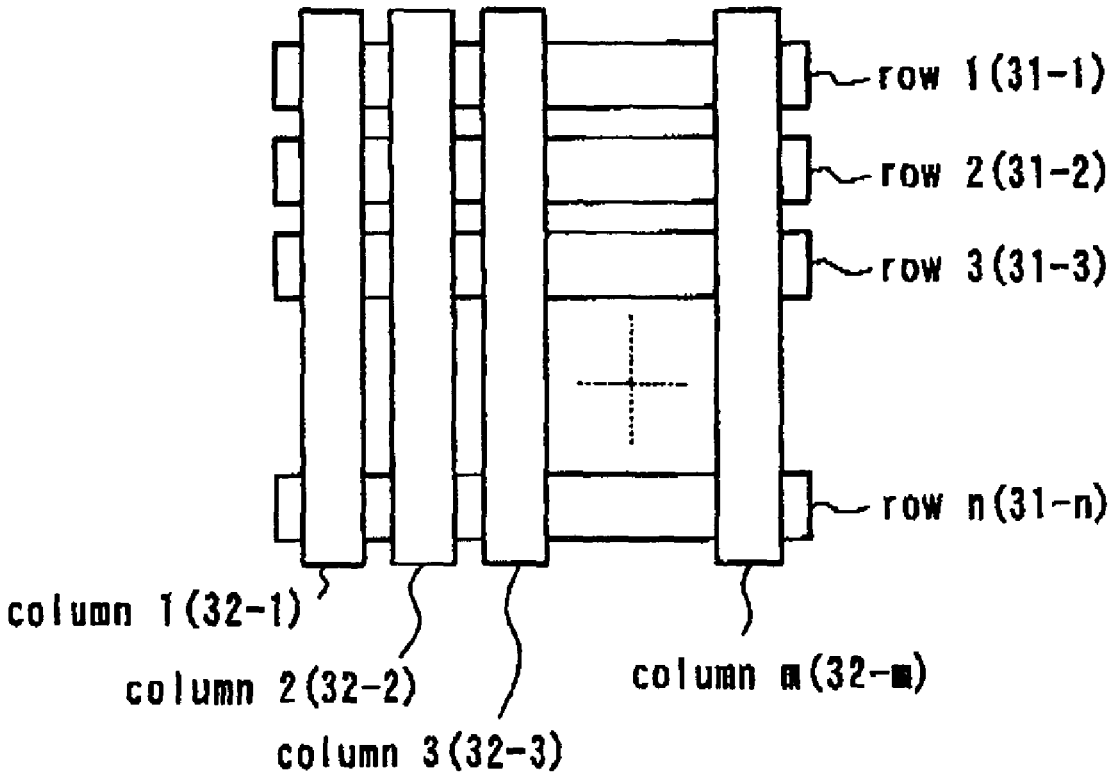
FIG. 19 is a schematic view explaining one embodiment of a passive matrix panel composed of a row electrode and a column electrode (third aspect of the invention).
Figure 20:
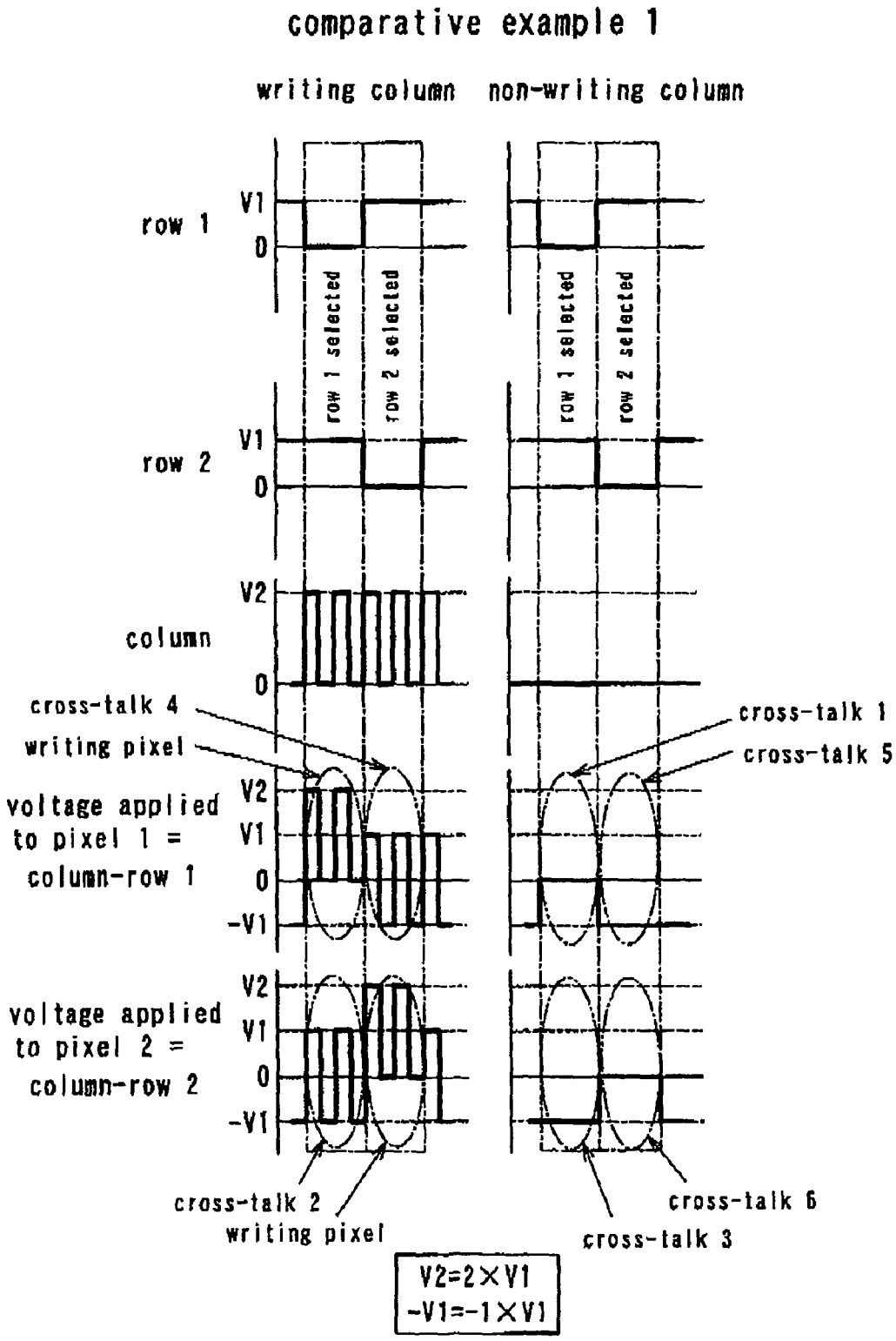
FIG. 20 is a schematic view explaining a driving method of a comparative example 1 (third aspect of the invention).
Figure 21:
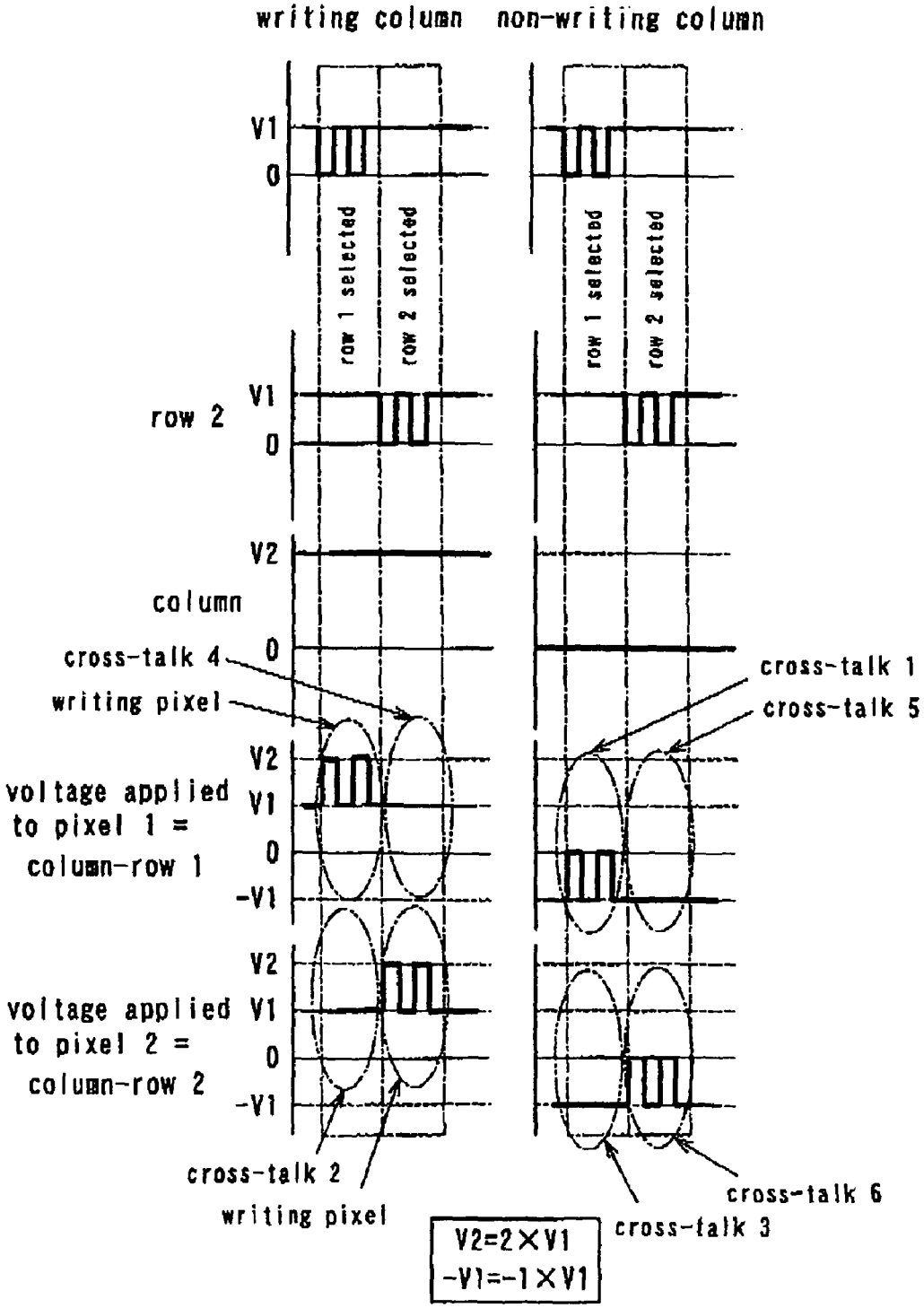
FIG. 21 is a schematic view explaining a driving method of an example 1 (third aspect of the invention).
Figure 22:
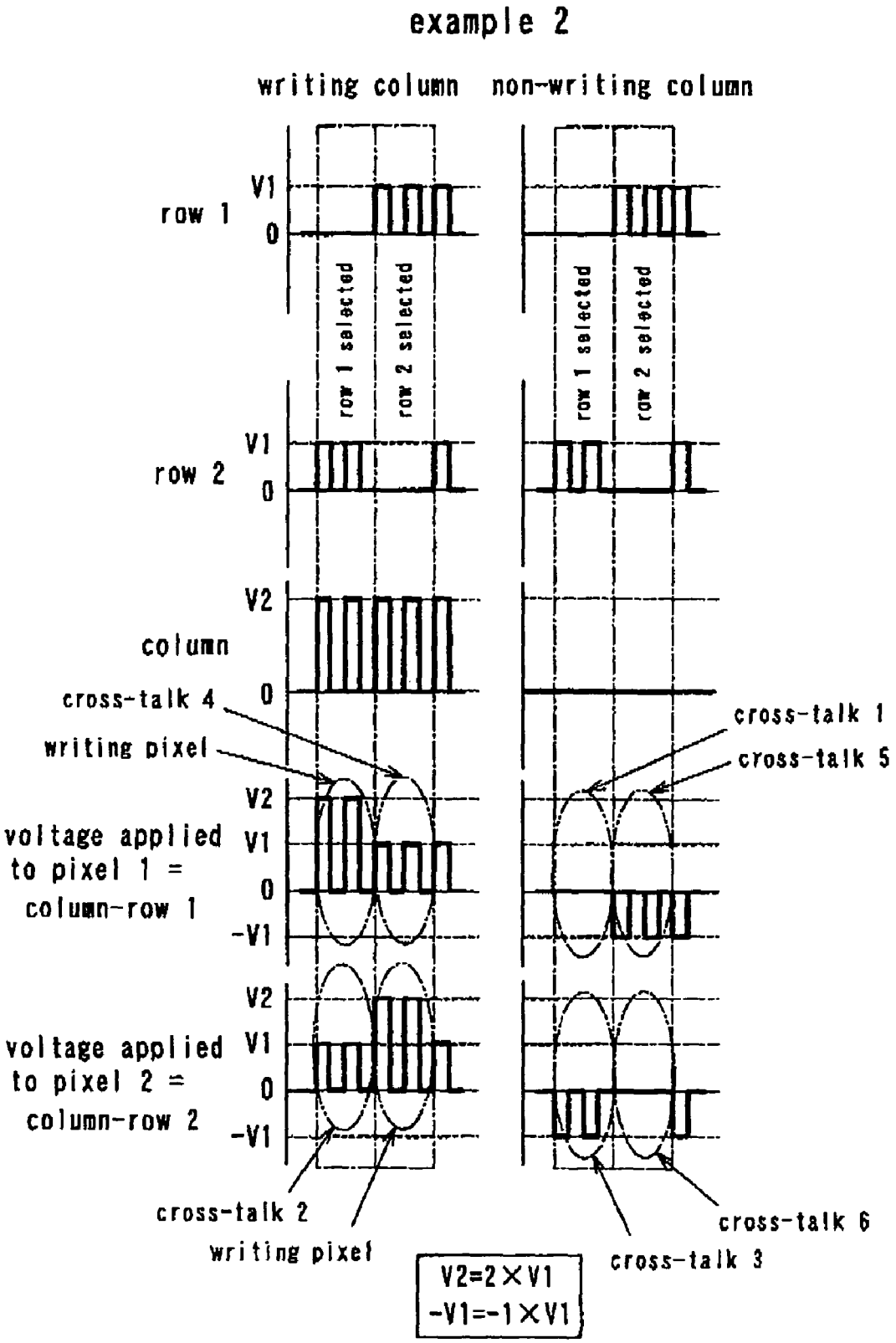
FIG. 22 is a schematic view explaining a driving method of an example 2 (third aspect of the invention).
Figure 23:
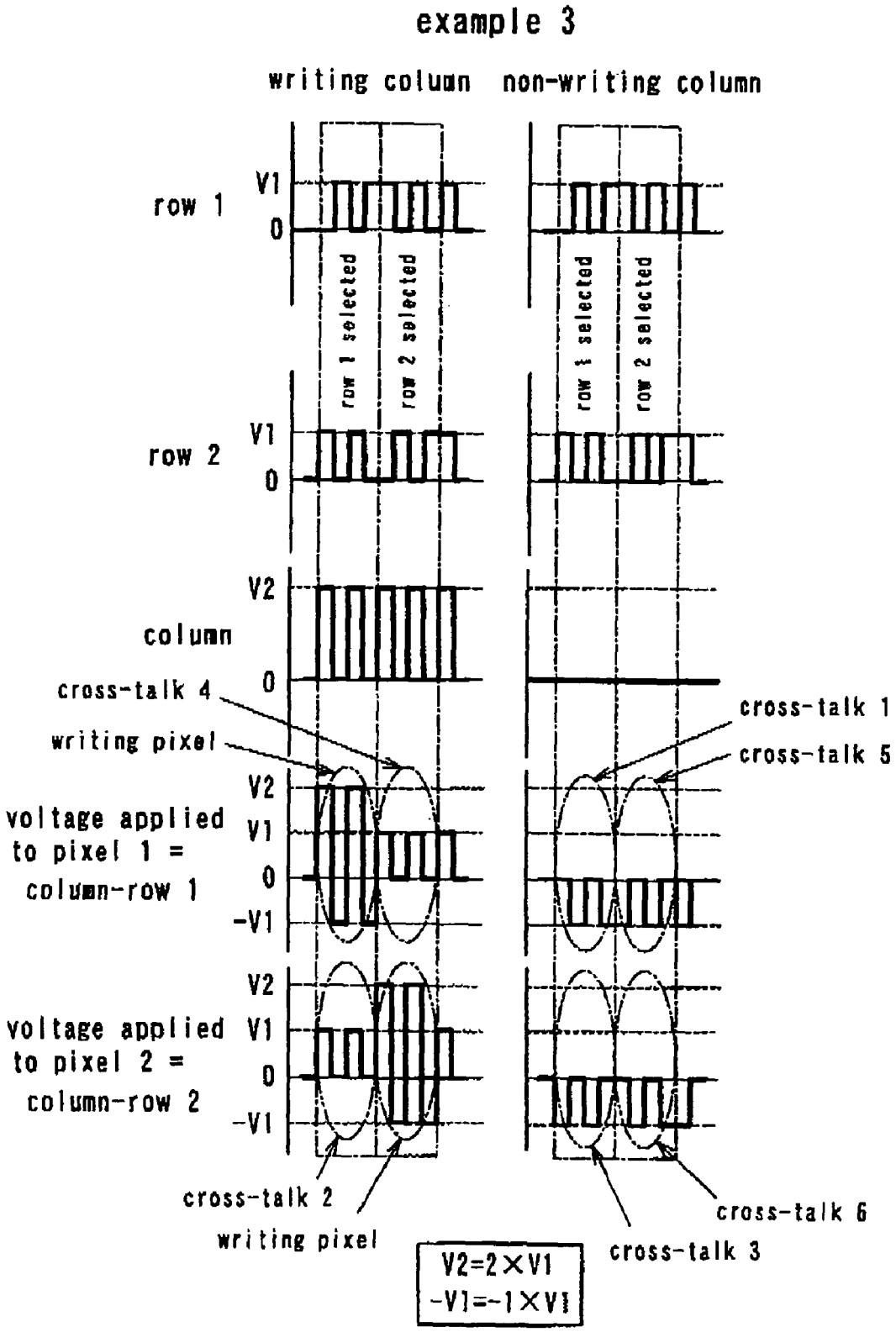
FIG. 23 is a schematic view explaining a driving method of an example 3 (third aspect of the invention)

At first, as shown in FIG. 19, a passive matrix panel, which was constructed by row electrodes 31-1 to **31-*n* and column electrodes 32-1 to 32-*m*, was manufactured. In the passive matrix panel, the row electrodes 31-1 to 31-*n* are selected one by one to rewrite one frame. Then, FIG. 20 shows a driving method of a comparative example 1, and FIGS. 21 to 23 illustrate a driving method of examples 1 to 3 respectively. In the driving methods shown in FIGS. 20 to 23, for the sake of simplicity of the explanation, the explanation is made to the passive matrix panel with two rows and two columns as is the same as the examples shown in FIGS. 11*a* and 11*b***, and a driving operation is performed in such a manner that a pulse voltage is applied two times for one rewriting operation (ON-OFF-ON-OFF). Moreover, a voltage waveform applied to row, column and respective electrodes and a voltage waveform applied to respective pixels are shown at a first row rewriting operation (selected) and a second row rewriting operation (selected).

COMPARATIVE EXAMPLE 1

In the driving method of the comparative example 1 shown in FIG. 20, a pulse was applied two times as a column rewriting voltage, while a row selected voltage was the same as the known one. In this embodiment, pulse voltages on a cross-talk 2 and a cross-talk 4 applied to a non-writing pixel vary their polarity in such a manner that one peak is +V1 and the other peak is −V1, and a peak-to-peak value is large. In both cases, the display media are easy to move and are strongly affected by the cross-talk, to that a contrast was deteriorated.

EXAMPLE 1

In the driving method of the example 1 shown in FIG. 21, a pulse was applied two times as a row selected voltage, while a column rewriting voltage was the same as the known one. In this embodiment, pulse voltages on cross-talk 1 to 3 and cross-talk 4 to 6 applied to a non-writing pixel have the same polarity. That is, a polarity of the cross-talk 1 and 6 is constant in such a manner that one peak is 0V and the other peak is −V1; a polarity of the cross-talk 2 and 4 is constant as +V1; and a polarity of the cross-talk 3 and 5 is constant as −V1. However, a peak-to-peak value of the rewriting voltage applied to a pixel is a half of the rewriting voltage (V2−V1). Therefore, a contrast is maintained as an excellent state, but an effect for an object of varying a dividing number of the applied pulse voltage from one time to plural times is reduced.

EXAMPLE 2

In the driving method of the example 2 shown in FIG. 22, use is made of a pulse train in which row/column is synchronized, and a pulse is removed when row is selected. In the case such that a bias voltage is not ½ of the driving voltage, an applied voltage after removing the pulse is not sometimes 0V. In this embodiment, pulse voltages on cross-talk 1 to 3 and cross-talk 4 to 6 applied to a non-writing pixel have the same polarity. That is, a polarity of the cross-talk 1 and 6 is constant as 0V; a polarity of the cross-talk 2 and 4 is constant in such a manner that one peak is +V and the other peak is 0V; and a polarity of the cross-talk 3 and 5 is constant in such a manner that one peak is 0V and the other peak is −V1. In the example 2, the cross-talk is influenced in such a manner that an improving effect of the example 1 is maintained as it is and a peak-to-peak value of the rewriting voltage is two times larger than that of the example 1. Therefore, a rewriting operation of the rewriting pixel can be performed effectively, and it was possible to prevent a variation of the non-rewriting pixel due to an influence of the cross-talk.

EXAMPLE 3

In the driving method of the example 3 shown in FIG. 23, a row (scam) driving voltage and a column driving voltage are constituted by a pulse train having same cycle and same duty respectively, and a phase of respective pulse train of the row driving voltage and the column driving voltage is inverted when a column at row side is selected. In this embodiment, pulse voltages on cross-talk 1 to 3 and cross-talk 4 to 6 applied to a non-writing pixel have the same polarity. That is, a polarity of the cross-talk 1 and 6 is constant in such a manner that one peak is 0V and the other peak is −V1; a polarity of the cross-talk 2 and 4 is constant as in such a manner that one peak is +V and the other peak is 0V; and a polarity of the cross-talk 3 and 5 is constant in such a manner that one peak is 0V and the other peak is −V1. In the example 3, the cross-talk is influenced in such a manner that an improving effect of the examples 1 and 2 is maintained as it is and a peak-to-peak value of the rewriting voltage is three times larger than that of the example 1. Therefore, a rewriting operation of the rewriting pixel can be performed effectively, and it was possible to prevent a variation of the non-rewriting pixel due to au influence of the cross-talk more preferably.

In the examples 1 to 3 and the comparative example 1 mentioned above, positive and negative of the applied voltage was determined on the basis of 0V as a standard, but it is not necessary to set a standard to 0V for driving the image display device according to the invention. In this case, a constant value at a positive side or a constant value at a negative side may be defined with respect to a standard voltage in spite of the 0V standard. Moreover, a bias voltage applied to the non-selected row is defined as V1 (=(V2)/2) i.e. a half of a rewriting voltage V2 applied to the column, but such situation is not restricted and for example the bias voltage V1 may be ((V2)/3).

<Confirmation of Effect>

Figure 24:
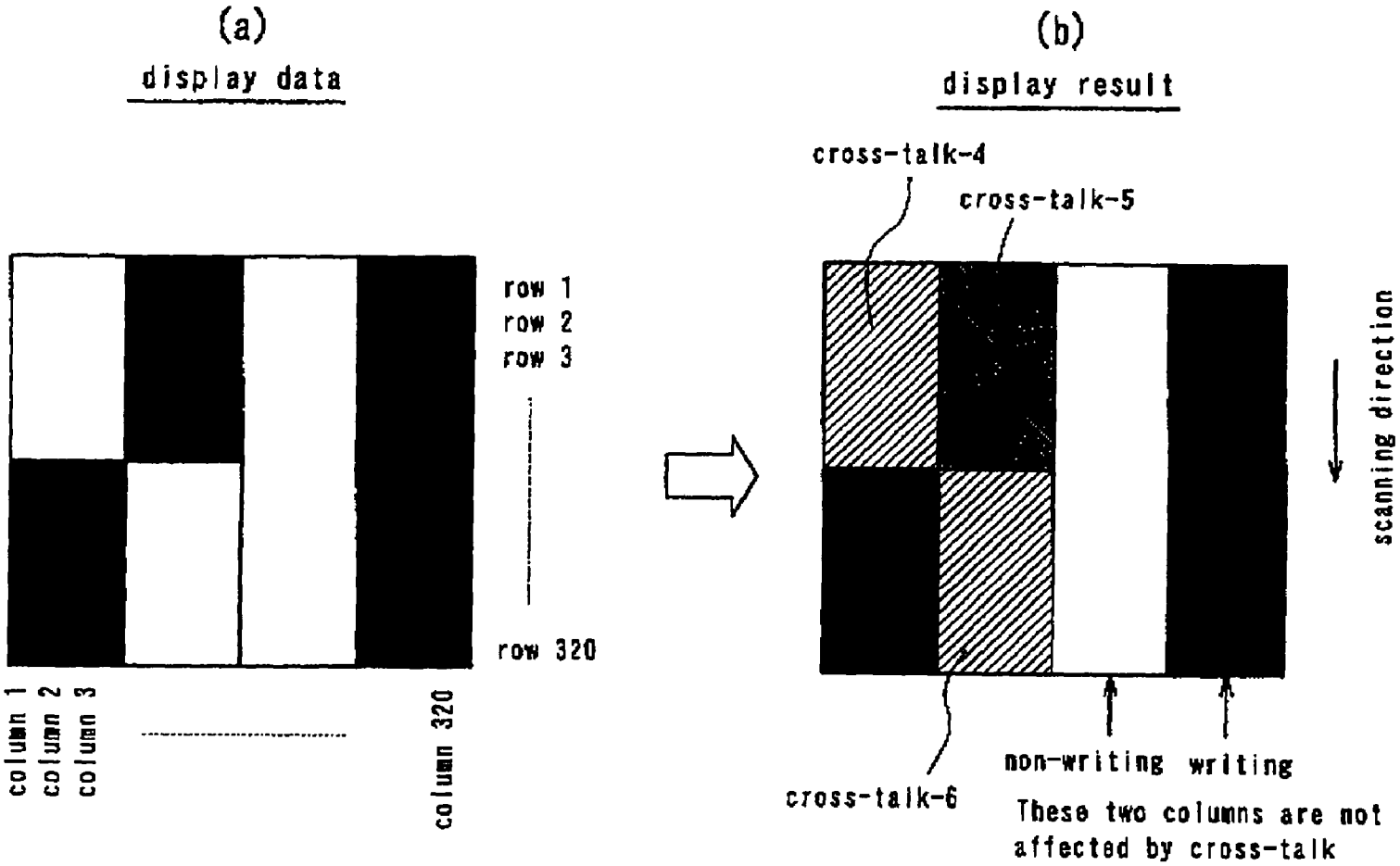
FIGS. 24*a* and 24*b* are schematic views respectively explaining a test pattern and a measuring position on the test pattern (third aspect of the invention).

A test pattern was displayed on the passive matrix panel with 320 lines at row (scan) side and 320 lined at column side shown in FIG. 24*a*, which was driven by the driving method of the examples 1 to 3 and the comparative example 1 mentioned above, and reflection of a rewriting (no cross-talk) area and reflection of a cross-talk area (cross-talk 4 to 6 mentioned above) shown in FIG. 24*b* were measured by an optical densitometer (RD-1 produced by GretagMacbeth AG). The driving conditions were as follows. That is, the number of applied rewriting voltages for 1 pixel was 8; it was driven by the driving voltage at which a contrast was maximum and an influence of the cross-talk 4 was minimum; and non-selected column/row was biased by ½ of the driving voltage. The results are shown in the following Table 2.

TABLE 2

| Measuring point | Comparative example 1 | Example 1 | Example 2 | Example 3 |
|---|---|---|---|---|
| Cross-talk 5 (difference with rewriting) | 1% | 1% | 2.5% | 2.5% |
| Cross-talk 4 (difference with non-rewriting) | 7% | 1% | 3% | 3% |
| Cross-talk 6 (difference with non-rewriting) | 0.5% | 0.5% | 0% | 0.5% |
| Display state after rewriting | Excellent cross-talk, but remarkable cross-talk | Contrast somewhat decrease, but unremarkable cross-talk | Excellent cross-talk, but unremarkable cross-talk | Excellent cross-talk, but unremarkable cross-talk |

From the results shown in Table 2, it is understood that the examples 1 to 3, in which polarities of the pulse voltage on the cross-talk 1 to 3 and the cross-talk 4 to 6 applied to the non-writing pixel are constant, have a small density variation and an unremarkable cross-talk, as compared with the comparative example 1, in which polarities of the pulse voltages on the cross-talk 2 and 4 applied to the non-writing pixel are not constant. Moreover, in the case of comparing the examples 1 to 3, it is understood that, if the peak-to-peak value of the rewriting voltage becomes larger, a density variation becomes small and the cross-talk becomes unremarkable.

INDUSTRIALLY APPLICABILITY

The image display device, which is an object of the driving method according to the invention, is applicable to the image display unit for mobile equipment such as notebook personal computers, PDAs, cellular phones, handy terminal and so on; to the electric paper for electric book, electric newspaper and so on; to the bulletin boards such as signboards, posters, blackboards and so on; to the image display unit for electric calculator, home electric application products, auto supplies and so on; to the card display unit for point card, IC card and so on; and to the display unit for electric POP, electric advertisement, electric price tag, electric bin tag, electric musical score, RF-ID device and so on.

The invention claimed is:

1. A method of driving an information display device, in which two groups of display media having at least a first color and a second color are sealed between opposed two substrates, at least one substrate being transparent, and, in which the display media, to which an electrostatic field is applied from electrodes arranged respectively to the substrates, are made to move so as to display information such as an image, the method comprising:

displaying information of one frame by performing a scanning operation with respect to line electrodes comprising a plurality of electrodes extending in a line direction on one substrate and column electrodes comprising a plurality of electrodes extending in a column direction on the other substrate in such a manner that a voltage is applied to the line electrodes from one end to the other end, and applying a voltage for generating a cross-talk in the first color and a voltage for generating a cross-talk in the second color to all cells of a display portion one or more times respectively after the one frame is displayed, wherein the information of the one frame is an image, and wherein two or more lines of line electrodes are added at the end of the scanning operation, and a drive, in which a display of the first color and a display of the second color are performed one or more times respectively, is performed after the scanning operation is finished.

2. The method of driving the information display device according to claim 1, wherein a deleting operation of the image prior to the image display is performed by a line deleting method in which the image is written one by one for the lines after the lines are deleted respectively, or, by a full deleting method in which the image is written one by one for the lines after all the lines are deleted at the same time.

3. The method of driving the information display device according to claim 1, wherein a deleting operation of the image prior to the image display is performed by a line deleting method in which the image is written one by one for the lines after the lines are deleted respectively, or, by a full deleting method in which the image is written one by one for the lines after all the lines are deleted at the same time.

* * * * *